US005839018A

United States Patent [19]

Asanuma et al.

[11] Patent Number: 5,839,018

[45] Date of Patent: Nov. 17, 1998

[54] TONER DENSITY CONTROL FOR AN IMAGE FORMING APPARATUS

[75] Inventors: Masato Asanuma, Nara; Toshiaki Ino, Yamatokoriyama; Kanshiro Okamoto, Memphis; Hideji Saiko, Yamatokoriyama; Toshihisa Ishida, Kashiba; Katsuaki Sumida, Kitakatsuragi-gun; Motoyuki Itoyama, Yamatokoriyama; Hiroo Naoi, Yamatokoriyama; Mitsuru Tokuyama, Nara; Eisaku Hatanaka, Yamatokoriyama; Yuichiro Takesue, Nara; Jitsuo Masuda, Yamatotakada; Masayasu Narimatsu; Yasuo Kitabatake, both of Nara, all of Japan

[73] Assignee: Sharp Kabushiki Kaisha, Osaka, Japan

[21] Appl. No.: 625,997

[22] Filed: Apr. 1, 1996

[30] Foreign Application Priority Data

| | | | |
|---|---|---|---|
| Apr. 3, 1995 | [JP] | Japan | 7-077745 |
| Jun. 14, 1995 | [JP] | Japan | 7-147297 |
| Sep. 21, 1995 | [JP] | Japan | 7-243222 |

[51] Int. Cl.[6] ..... G03G 15/00

[52] U.S. Cl. ..... 399/43; 399/44; 399/46; 399/50; 399/62

[58] Field of Search ..... 399/43, 44, 49, 399/50, 58, 59, 62, 46

[56] References Cited

U.S. PATENT DOCUMENTS

| | | | |
|---|---|---|---|
| 4,105,324 | 8/1978 | Seil | 399/43 |
| 4,564,287 | 1/1986 | Suzuki et al. | 399/43 |
| 4,734,737 | 3/1988 | Koichi | 399/58 |
| 5,006,896 | 4/1991 | Koichi et al. | 399/74 |
| 5,057,867 | 10/1991 | Ishigaki et al. | 399/43 |
| 5,124,751 | 6/1992 | Fukui et al. | 399/44 |
| 5,162,855 | 11/1992 | Nakagama et al. | 399/43 |
| 5,204,718 | 4/1993 | Morita | 399/74 |
| 5,312,589 | 5/1994 | Brannan et al. | 399/43 |
| 5,387,965 | 2/1995 | Hasegawa et al. | 399/60 |
| 5,402,209 | 3/1995 | Itoyama et al. | 399/46 |
| 5,574,543 | 11/1996 | Sakai et al. | 399/59 |

FOREIGN PATENT DOCUMENTS

| | | |
|---|---|---|
| 0029508 | 6/1981 | European Pat. Off. . |
| 3742150 | 6/1988 | Germany . |
| 60-2661B2 | 2/1979 | Japan . |
| 62-25778 | 2/1987 | Japan . |
| 62-218977 | 9/1987 | Japan . |
| 4-333079 | 11/1992 | Japan . |
| 6-11929 | 1/1994 | Japan . |
| 6-19259 | 1/1994 | Japan . |
| 6-51551 | 2/1994 | Japan . |

*Primary Examiner*—William J. Royer

[57] ABSTRACT

The image forming apparatus of the invention controls the toner density by any one of the following configurations: by correcting the toner density of the developer in association with the agitation total; by controlling a process parameter so that the density of a toner patch formed on the photoreceptor corresponds to a prescribed density value and determining that developing performance of the developer is improved and canceling the toner density correction when the process parameter reaches the prescribed value; by changing the toner density reference value when the variation as to the charger output is equal to or greater than a first predetermined value and maintaining the changed toner density reference value until the variation of the charger output again becomes equal to or greater than the first predetermined value; or by prohibiting toner supply for a constant duration to prevent excessive toner supply if time from the end of the last operation of the developing unit to the start of a next operation, inclusive of the power-activation is equal to or longer the a predetermined period when the developing unit is activated to commence agitation of the developer.

27 Claims, 31 Drawing Sheets

FIG. 9

| TOTAL ROTATING TIME | | REFERENCE VOLTAGE | |
|---|---|---|---|
| CNT | [SEC.] | | [V] |
| 0 | 0~99 | V0 | 2.375 |
| 1 | 100~199 | V1 | 2.355 |
| 2 | 200~299 | V2 | 2.335 |
| 3 | 300~399 | V3 | 2.315 |
| 4 | 400~499 | V4 | 2.295 |
| 5 | 500~599 | V5 | 2.275 |
| 6 | 600~699 | V6 | 2.255 |
| 7 | 700~799 | V7 | 2.235 |
| 8 | 800~899 | V8 | 2.215 |
| 9 | 900~999 | V9 | 2.195 |
| 10 | 1000~1099 | V10 | 2.175 |
| 11 | 1100~1199 | V11 | 2.155 |
| 12 | 1200~1299 | V12 | 2.135 |
| 13 | 1300~1399 | V13 | 2.115 |
| 14 | 1400~1499 | V14 | 2.095 |
| 15 | 1500~1599 | V15 | 2.075 |
| 16 | 1600~1699 | V16 | 2.055 |
| 17 | 1700~1799 | V17 | 2.035 |
| 18 | 1800~1899 | V18 | 2.015 |
| 19 | 1900~1999 | V19 | 1.995 |
| 20 | 2000~19999 | V20 | 1.975 |
| 21 | 20000~ | | |

TONER DENSITY CONTROL FOR AN IMAGE FORMING APPARATUS

BACKGROUND OF THE INVENTION

1. Field of the Invention

Thy present invention relates to an image forming apparatus such as copiers, laser printers, PPC facsimiles and the like, having a photoreceptor and using the electrophotographic process wherein a static latent image is formed on the photoreceptor and developed into a visual image by the developer, and in particular relates to a toner density control for creating stabilized images in such an image forming apparatus.

More detailedly, the present invention relates to an image forming apparatus including: a developing unit for developing a static latent image with a two-component developer consisting of toner and carriers; a toner density detecting unit provided in the developing unit for measuring the magnetic permeability of carriers to output the measurement as a reference toner density; and an automatic toner control device wherein toner density is controlled by comparing the toner density inside the developing unit with the reference toner density outputted from the toner density detecting unit and supplying toner into the developing unit to adjust the toner density so as to correspond to the reference toner density.

2. Description of the Background Art

In an image forming apparatus effecting image forming based on the electrophotography using a two-component developer consisting of toner and carriers, in order to maintain the toner density of the developer, the toner density inside the developing vessel in the developing unit is detected by a toner density sensor. The detected level is compared with a predetermined reference toner density and supplying amount of the toner to the developing vessel is controlled based on the comparison so that the output from the toner density sensor is made equal to the reference toner density. The above-mentioned toner density sensor typically uses a magnetic permeability sensor which detects the variation of inductance of the developer and detects the toner density utilizing the fact that the magnetic permeability depends on the ratio of the toner as a non-magnetic material and the carriers as a magnetic material. As such a two-component developer is charged by mixing and agitating inside the developing vessel, the apparent volume density of the developer will change depending on the quantity of charge carried on the toner. This physical change of the developer changes the inductance even if the toner density of the developer is unchanged. Therefore, the detection of the toner density involves errors depending on the quantity of charge. Consequently, it is impossible to keep the practical toner density constant.

To deal with this, it is disclosed in Japanese Patent Application Laid-Open Sho 62 No. 25,778, that the detection error of the toner density sensor due to the variation of the quantity of charge on the developer is compensated by modifying the supply amount of toner as the number of copies increases, which has been counted from the replacement of the developer in the developing unit. FIG. 2 is a chart showing the change of the quantity of charge versus the number of copies. As seen from this chart the quantity of charge relatively rapidly increases at the initial stage as the number of the copies increases and thereafter the charge quantity gradually decreases to a stabilized state. In the case where the toner density sensor detects the density of toner based on the inductance, the sensor output lowers as the toner density is large as shown in FIG. 3 while as seen in FIG. 4, the sensor output lowers as the quantity of charge on the developer becomes great. Accordingly, as the charge quantity on the developer becomes greater, the toner density tends to be estimated greater than the actual toner density. As a result of the automatic toner density control of the developer in association with the output from the toner density sensor, the density of the image formed lowers at the initial stage as the number of the copies increases and then recovers to the normal state as shown in FIG. 1.

As disclosed in the above publication, if the toner density is modified in association with the number of copies, the initial lowering of the image density can be compensated. The quantity of charge on the developer, however, is affected by the conditions on which the developer is mixed and agitated, that is, the temperature and moisture of the environment or by the operated condition of the developing unit and will not change in a unique manner. The charging performance itself will also lower due to the degradation of the developer. As a result, although it is possible to effect the correction of the toner density properly in the initial stage, the compensation becomes excessive gradually with the augment of the number of copies. As a result, degradation of image could occur such as the image density becomes high and the toner scattering could occur to pollute the machine inside.

Further, as stated heretofore, in the case that the two-component developer consisting of toner and carriers is used to effect the development, if the toner density of the developer inside the developing vessel, or the ratio of mixing of carriers and toner is not appropriate, the image density becomes too low to be made out, or the image becomes to have too high a density and a foggy image is produced. Alternatively, there are other possibilities such as of toner scattering or the like. Used in the conventional copier, laser printer or the like is a toner density sensor which detects toner density by measuring the change of the apparent volume density of the developer, for example, as a change of magnetic permeability. In such a configuration, an output value (output voltage) from the toner density sensor when the developer having an optimal toner density has been well agitated is previously set into the memory as a reference value (reference voltage). Then toner supply control is effected so that the output value from the toner density sensor may meet the reference value to thereby maintain the toner density, appropriately.

However, as the developer has been agitated with great stress in the developing vessel over a prolonged period of time, toner particles could stick to the surface of carriers, the coating agent may peel off the carrier surface, or the toner particles may be made small in diameter. The flow property and other factors of the developer vary due to the degradation by such phenomena, whereby the output value from the toner sensor is caused to change despite that the toner density of the developer is unchanged. Therefore, it might be impossible to keep the toner density appropriately by the toner supplying control based on merely the output value from the toner density sensor.

To deal with this, a method of the toner density control has been done under the consideration of the used state of the developer. That is, in order to estimate the used state of the developer, the occurrences of copies made are counted. And the reference value in the toner density sensor is corrected by a predetermined constant determined depending on the total number of copies so that the utility state of the developer is taken into account to thereby maintain the toner density appropriately.

The output value from the toner density sensor is affected by the quantity of charge which is generated on the toner by friction between toner and carriers when the developer is agitated. For example, when the quantity of charge on the toner increases, the apparent volume density of the developer lowers, and therefore the output value from the toner density sensor lowers. In contrast, if the quantity of charge on the toner decreases, the apparent volume density of the developer increases, and therefore the output value from the toner sensor increases.

Accordingly, in the conventional configuration, the toner density sensor may present a proper output value reflecting the actual toner density when the developer has been well agitated during copying or right after copying. However, if the developer is not agitated but has been left as it is for a long time, the quantity of charge on the toner lowers due to leak of charge and consequently, the output value from the toner density sensor increases. That is, despite that the actual toner density is unchanged, the output value from the toner density sensor could change. As a result, when a copying operation is done after a prolonged deactivation, the toner density sensor outputs a greater value than the reference value despite that the developer has a correct toner density, whereby the sensor erroneously detects that the toner density is low (or the developer is in the under-toner state) and effects toner supply. This oversupply of toner inhibits sufficient generation of charge and causes excess density, background fog, toner scattering etc. in the copied image.

Since the electrification of the developer largely depends on the environmental conditions; for example, the rising performance of charge on toner is poor under a high-humid environment, the output value from the toner density sensor varies greatly. Nevertheless, in the conventional configuration, the toner density sensor effects the toner density detection without regard to the environmental conditions, so that the output value from the toner density sensor fluctuates and therefore it was impossible to create images with stabilized toner density at any time.

Japanese Patent Publication Sho 60 No.2,661 discloses a way of properly keeping the toner density. In this configuration, generated is a correcting signal which corresponds to the level difference between the detection by the toner density means when an operation of the developing unit was stopped and the detection when a next operation is started. When the operation of the developing unit is activated, the deviation of the output detected by the detecting means right after the operation start of the developing unit from the last detection is compensated by adding the correcting signal to the output signal and attenuating the correction signal as time elapses, whereby proper toner density can be maintained.

However, there is a fear that the scheme proposed in Japanese Patent Publication Sho 60 No.2,661 does not work effectively. Consider a case that the developer has not been agitated well because, for example, the developing unit is deactivated right after toner supply. In this case, the detection level detected by the toner density detecting means does not indicate the actual toner density. Then, when the developing unit is activated after the developer has been left for a while in the above state, the output signal from the toner density detecting means at the start of the operation of the developing unit is corrected by adding the correcting signal which corresponds to the level difference between the detection by the toner density means when the last operation of the developing unit was stopped and the detection when this operation is started. However, the detection level by the toner density detecting means at that time does not indicate the actual toner density. Accordingly, despite that the toner density is correct, the developer is erroneously detected as in the under-toner state until the developer will have been agitated enough, and during this period, toner supply could be continued.

Japanese Patent Publication Sho 60 No.2,661 also discloses a method in which correction of toner density is made by comparing the detection level by the toner density detecting means at the start of the operation with a control reference level for the toner density detecting means and adding the correcting signal to the output signal from the toner density detection means at the start of the operation of the developing unit, but this method also involves anxieties over occurrences of the problems described above.

Further, the conventional copier, laser printer, PPC facsimiles or the like uses devices and supplies such as a charging device, exposure device, photoreceptor and developer. These devices and supplies have characteristics depending on environmental surroundings (temperature and humidity) and time-dependence characteristics. Since images obtained by charging and exposing the photoreceptor and the development of it must be affected by those factors, the image tends to be unstable.

To deal with the above problems, recent copiers, laser printers or PPC facsimiles or the like incorporate an image stabilizing device as disclosed in Japanese Patent Application Laid-Open Hei 6 No.51,551, Japanese Patent Application Laid-Open Hei 6 No.19,259 or Japanese Patent Application Laid-Open Hei 6 No.11,929, in order to stabilize the output image by controlling the process conditions (on charging, exposure and development).

Japanese Patent Application Laid-Open Hei 6 No.51,551 proposed a correcting scheme of electrophotographic-process parameters by preparing a toner patch in a predetermined area on the photoreceptor surface and detecting the density of the toner patch and the non-image area, comparing them to each other and determining the process parameters based on the comparison.

Japanese Patent Application Laid-Open Hei 6 No.19,259 proposed a correcting scheme in which the copy lamp voltage is changed whenever a certain number of copies have been made and the relation between the output from the original density detection sensor and the developing bias voltage is corrected based on the magnitude of the change of the copy lamp voltage.

Japanese Patent Application Laid-Open Hei 6 No.11,929 proposed a process control of the toner patch scheme in which the post-transfer amount of toner adhered in the toner patch portion on the photoreceptor is detected to determine the transfer efficiency and the erasure output is controlled based on the ratio.

In the conventional typical image stabilizing apparatuses as described above, the control can be effected to a certain degree of precision, still it is difficult to precisely make corrections for the variations arising due to environmental characteristics (temperature and humidity) or with the passage of time and therefore it is difficult to maintain the same quality of image as in the initial stage up to the final stages. Therefore, it is also important to appropriately keep the toner density in the developer in order to maintain the quality of image at a high level.

For example, since the quantity of charge on the toner in the developer as having been exposed to a high temperature and humidity environment and/or not used for a prolonged period becomes low, various problems occur such as lowering of tone reproducing performance due to the image density rise, increase of toner consumption, increase of background fog, toner scattering and the like. Therefore, it is necessary to lower the toner density in the developing unit. On the other hand, since the quantity of charge on the toner in the developer as having been exposed to a low temperature and humidity environment and/or after a continuous operation of copies becomes high, problems such as lowering of the image density, lowering of transfer performance and the like occurs. Therefore, it is necessary to increase the toner density in the developing unit.

SUMMARY OF THE INVENTION

The present invention has been achieved to solve the above problems in view of what has been described above.

It is therefore an object of the present invention to provide an image forming apparatus for solving the above problems by canceling the corrections when the toner density formed in the actual image forming is recovered to a predetermined density value.

Another object of the invention is to provide an image forming apparatus which is able to maintain the toner density of the developer appropriately by estimating the variation of the developer over a prolonged period of not being used as well as estimating environmental conditions and the like.

Since, of the process conditions (charging, exposure and development) which are controlled by detecting a toner patch formed on the photoreceptor, the charger output is corrected to be lowered when the apparatus is exposed to a high temperature and high humidity environment or not used over a prolonged period while it is corrected to be increased when the apparatus is exposed to a low temperature and low humidity environment or used for a continuous copying operation, it is a further object of the invention to create stabilized images substantially free from poor density and background fog by detecting the change of the variation in the charger output and determining whether the toner density correcting reference value is high or low to appropriately control the toner density inside the developing unit.

Suppose that the apparatus is constructed such that corrections of the toner density is canceled after a certain number of copies have been made, it is not always possible to cancel the toner density corrections at appropriate timing since electrification performances of the developer differ depending on the use conditions or degradation levels of the developer. In order to correct the toner density control by toner supply while actual developing performances of the developer is being detected, an image forming apparatus in accordance with a first feature of the invention includes: a toner density sensor for detecting the toner density of a two-component developer stored in a developing vessel; toner density control unit for comparing the output from the toner density sensor with a reference toner density and maintaining the toner density of the developer at the reference toner density by controlling the amount of supplying toner to the developing vessel; agitation total detecting unit for detecting as an agitations total the number of agitation of the developer inside the developing vessel, or the approximate operation time of the image forming apparatus or the number of images formed, either of which is proportional to the number of agitations; toner density correcting unit for correcting the output from the toner density sensor or the reference toner density in association with the augment of the agitation total; toner patch density detecting unit for creating a toner patch on the photoreceptor and detecting the density of the toner patch; process parameter controlling unit for controlling process parameters including an applied voltage to the main charger so as to adjust the toner patch density detected by the toner patch density detecting unit to a predetermined density value; and toner density correction canceling unit for canceling the correction by the toner density correcting unit when the process parameter has reached a predetermined value with improvement of developing performances of the developer.

In order to prevent a sharp transition of the image density when the above correction is canceled, in an image forming apparatus in accordance with a second feature of the invention, the toner density correction canceling unit is adapted to gradually reduce the correcting quantity by the toner density correcting unit with the augment of the agitation total.

In order that images formed under the condition right after the cancellation of the above correction is to be made in proper toner density, an image forming apparatus in accordance with a third feature of the invention further includes an approach for activating the process parameter controlling unit after the toner density correction canceling unit has canceled the correction set up by the toner density correcting unit In accordance with a fourth feature of the invention an image forming apparatus includes: a toner density detecting portion for detecting the toner density of a two-component developer consisting of toner and carriers and stored in a developing vessel in the developing unit; a toner supplying portion for supplying toner into the developing vessel until the output value from the toner density detecting portion reaches a reference value; inactive-interval measuring unit for measuring an interval from the end of operation of the developing unit to the start of a next operation thereof; and toner supply controlling unit for prohibiting the toner supply to be effected by the toner supplying portion for a constant duration from the activation of the developing unit when the inactive interval is equal to or longer than a predetermined period of time.

In accordance with a fifth feature of the invention an image forming apparatus includes: a toner density detecting portion for detecting the toner density of a two-component developer consisting of toner and carriers and stored in a developing vessel in the developing unit; a toner supplying portion for supplying toner into the developing vessel until the output value from the toner density detecting portion reaches a reference value; inactive-interval measuring unit for measuring an interval from the end of operation of the developing unit to the start of a next operation thereof; and toner supply controlling unit for setting up a reference value for the toner density detecting portion in conformity with the inactive interval and regulating the toner supply to be effected by the toner supplying portion based on the setup reference value.

Next, sixth and seventh features of the invention reside in an image forming apparatus having the fourth or fifth configuration wherein a warm-up period of a fixing unit for fusing and fixing toner transferred to a recording sheet from the activation of power supply to when the fixing unit reaches a prescribed temperature is measured in place of measuring the interval from the end of operation of the developing unit to the start of a next operation thereof, and toner supply is effected based on the warm-up period.

Next, eighth and ninth features of the invention reside in an image forming apparatus having the fourth or fifth, configuration wherein the temperature of a fixing unit for fusing and fixing toner transferred to a recording sheet is measured immediately after the activation of power supply in place of measuring the interval from the end of operation of the developing unit to the start of a next operation thereof, and toner supply is effected based on the temperature.

Next, in accordance with tenth through fourteenth features of the invention, an image forming apparatus having any one of the fifth through ninth configurations further includes reference value correcting unit for correcting the reference value set up for the toner density detecting portion, in accordance with environmental conditions.

Next, in accordance with fifteenth through nineteenth features of the invention, an image forming apparatus having any one of the fifth through ninth configurations further includes reference value correcting unit for correcting the reference value set up for the toner density detecting portion, in accordance with the use total of the developer.

A twentieth feature of the invention resides in an image forming apparatus wherein the image density is controlled regularly by forming a patch of toner on the photoreceptor and varying the charger output as one of image forming conditions based on the density of the patch and control of toner supply to the developing unit is effected so that the toner density in the developing unit corresponds to a toner density reference value and the image forming apparatus is constructed such that when the variation as to the charger output is equal to or greater than a first predetermined value, the toner density reference value is changed, then the changed toner density reference value is maintained until the variation of the charger output again becomes equal to or greater than the first predetermined value.

Further, a twenty-first feature of the invention resides in an image forming apparatus having the twentieth configuration wherein after a change of the toner density reference value, another change of the toner density reference value is prohibited for a predetermined period of time.

Moreover, a twenty-second feature of the invention resides in an image forming apparatus having the twentieth configuration wherein after the modification of the toner density reference value, if the variation of the charger output is equal to or greater than a second predetermined value, it is detected that the apparatus is in an anomalous state.

In the image forming apparatus in accordance with the first feature of the invention, the toner density sensor detects the toner density of the developer stored in the developing vessel; and the toner density control unit compares the output from the toner density sensor with a reference toner density and maintains the toner density of the developer at the reference toner density by controlling the amount of supplying toner to the developing vessel. On the other hand, the agitation total detecting unit detects as an agitations total the number of agitation of the developer inside the developing vessel, or the operation time of the image forming apparatus approximately or the number of images formed, either of which is proportional to the number of agitations; and the toner density correcting unit corrects the output from the toner density sensor or the reference toner density in association with the augment of the agitation total. Thus, the lowering of the image density at the initial stage of the developer can be corrected. The toner patch density detecting unit creates a toner patch on the photoreceptor and detects the density of the toner patch; and the process parameter controlling unit controls process parameters including an applied voltage to the main charger so as to adjust the toner patch density detected by the toner patch density detecting unit to a predetermined density value. The toner density correction canceling unit cancels the correction by the toner density correcting unit when the process parameter has reached a predetermined value with improvement of developing performances of the developer.

In the above operation, the toner density correcting unit corrects the lowering of the image density at the starting stage of the developer such that, for example, as shown in FIGS. 5 and 6, the apparent toner density is increased as the agitation total of the developer increases and then cancels the toner density correction before the overcorrection occurs so that apparent toner density is restored to the original value at the time the correction is not made. As a result, it is possible to improve the quality of image and prevent the pollution of the machine inside due to toner scattering.

Abrupt transition of the toner density in the developer is conceivably attributed to the change of the electrification performances of the developer. In accordance with the image forming apparatus having the second feature, when the toner density correction is canceled as the agitation total of the developer increases, the correcting quantity set up by the toner density correcting unit is gradually reduced, for example, as shown in FIG. 6. Therefore it is possible to obtain stabilized images before and after the cancellation of the toner density correction.

In accordance with the image forming apparatus having the third feature, after the toner density correction canceling unit has canceled the correction set up by the toner density correcting unit, the process parameter controlling unit controls process parameters so that toner patch density corresponds to previously determined density. By this operation, it is possible to effect image forming with appropriate process parameters right after the toner density correction is canceled.

Next, in the approach for solving problems in accordance with the fourth feature of the invention, as the image forming is started, the developing unit operates to effect development as agitating the developer. During the developing operation, if the toner density lowers as the toner in the developing vessel is consumed, the toner supplying portion supplies toner until the output value from the toner density detecting portion reaches the reference value.

When the image forming is complete, the developing unit is stopped and left in the inactive state. As the inactive state becomes longer, the developer is pressed down by self-weight, or charges on toner leak and therefore the quantity of charge becomes low. As a result, the output value from the toner density detecting portion varies with the passage of time in the inactive state. Here, the inactive state or the state of being left includes a state in which the developer is not agitated while the power supply is on and a state in which the power supply is off.

To deal with the above situation, an inactive-interval ($T_1$) from the end of the last operation of the developing unit to the start of the operation inclusive of the activation of the power supply is measured. When the developing unit is activated and the developer is started to be agitated, if the inactive interval ($T_1$) is equal to or greater than a predetermined time ($T_\alpha$), the output value from the toner density portion varies and will not represent the actual toner density. Accordingly, toner supply to be effected by the toner supplying portion is prohibited for a previously set up constant duration Ta during which the output value from the toner density detecting portion recovers itself to a value in conformity with the actual toner density. In contrast, if the inactive interval ($T_1$) is shorter than the predetermined time ($T_\alpha$), it is assumed that the output value from the toner density detecting portion is conformed with the actual toner density, the normal toner supplying operation in conformity with the output value from the toner density sensor is effected from when the developing unit is activated. Thus, excessive toner supply is prevented at the start of the operation of the developing unit if the output value from the toner density detecting portion has varied over the prolonged period of inactive state.

In the approach for solving problems in accordance with the fifth feature of the invention, when the developing unit commences to be active to agitate the developer, a reference value for the toner density detecting portion is set up in accordance with an inactive interval ($T_1$) using a correction table classified as to different inactive intervals. Based on the reference value thus set up, the toner supply control is made in accordance with the output value from the toner density detecting portion. As a result, it is possible to effect precise toner density control.

In the approach for solving problems in accordance with the sixth and seventh features of the invention, a warm-up period from the activation of the fixing unit until the fixing unit reaches a prescribed temperature is measured to determine the inactive interval since the warm-up period is connected with the duration of the power supply being off. Accordingly, the warm up period ($T_2$) from the power-activation until the fixing unit reaches a prescribed temperature is measured and similar toner supply control to that in the fourth or fifth feature of the invention is effected based on the warm up period ($T_2$).

In the approach for solving problems in accordance with the eighth and ninth features of the invention, the temperature of the fixing unit is measured to determine the inactive interval since the temperature of the fixing unit right after the power-activation is connected with the duration of the power supply being off. Accordingly, the temperature ($T_3$) of the fixing unit before lighting the heat lamp when the power is turned on is detected, and similar toner supply control to that in the fourth or fifth feature of the invention is effected based on the temperature ($T_3$).

In the approach for solving problems in accordance with the tenth through fourteenth features of the invention, the reference value for the toner density detection portion is corrected in accordance with the environmental conditions such as humidity and the like. This is because that rising performance of the charge quantity on the developer largely depends on the environmental conditions even when agitation is equally done. That is, the quantity of charge rises quickly in a low temperature and low humidity condition whereas the quantity of charge rises slowly in a high temperature and high humidity condition. Therefore, the output value from the toner density detecting portion varies depending on variations of the environmental conditions.

In the approach for solving problems in accordance with the fifteenth through nineteenth features of the invention, it is considered that the rising performance of the charge quantity on the developer is degraded by toner (spent toner) stuck on carrier surfaces, peeling-off of the coating agent from carrier surfaces, pulverized toner particles, all caused when the developer has been pressed with strong agitating stress inside the developing vessel over a prolonged period of time. Accordingly, based on the use total of the developer, specifically, the total copy number or the total operation time of the developing unit, the reference value for the toner density detecting portion varies.

Next, in accordance with the twentieth feature of the invention, it is possible to prevent lowering of tone reproducing performance, augment of toner consumption, increased background fog, toner scattering and other defects, all attributed to the elevation of the image density due to the lowering of the quantity of charge on the developer as having been exposed to a high temperature and humidity environment or after a prolonged period of inactivity.

It is also possible to prevent occurrences of problems such as lowering of the image density, degradation of transfer performances and the like due to the elevation of the quantity of charge on the developer as having been exposed to a low temperature humidity environment, after a continuous copying operation or the like.

Thus, it is possible to effect appropriate toner density corrections and thus it possible to produce markedly stabilized images.

In accordance with the twenty-first feature of the invention, upon the change of the toner density reference value, copying must be continued to a certain degree right after the toner density reference value is changed, in order for the toner density of the developer to reach the modified reference value. Accordingly, it is possible to prevent redundant modification of the toner density reference value by correcting the charger output in the round of the process control which would be activated by erroneous determination that the modification of the toner density has not been performed yet despite that actual change of the toner density reference value has been done. As a result, it is possible to effect more stabilized control of the toner density inside the developing unit.

In accordance with the twenty-second feature of the invention, if the toner density reference value has been modified so as to increase the toner density inside the developing unit, the charger output is adapted to be corrected to be lower. In contrast, if the toner density reference value has been modified so as to decrease the toner density inside the developing unit, the charger output is adapted to be corrected to increased. Nevertheless, after the modification of the toner density reference value, the charger output deviates beyond the predetermined maximum or minimum, it is judged that some trouble happens in the image forming apparatus and consequently the apparatus can be determined in an anomalous state.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 9 is a table showing a relation between total rotating time and reference voltages determined based on the total rotating time;

DESCRIPTION OF THE PREFERRED EMBODIMENTS

Figure 7:
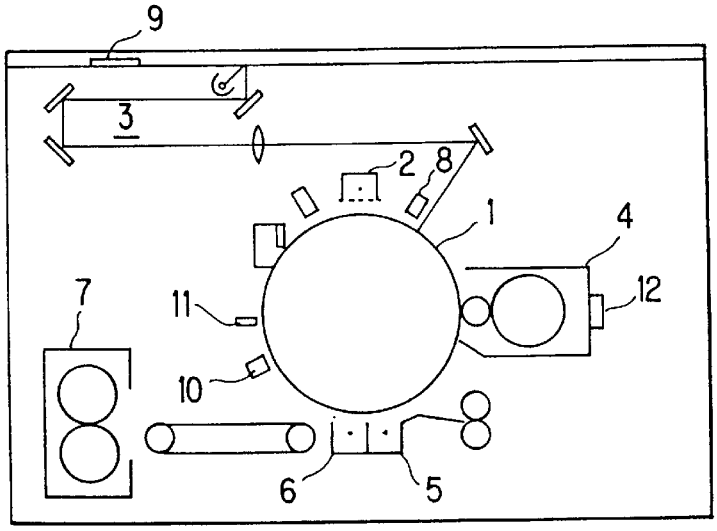
FIG. 7 s a schematic sectional view showing an image forming apparatus of an embodiment of the invention.

FIG. 7 is a schematic sectional view of a copier. Designated at 1 is a photoreceptor which is formed of an aluminum drum with a photoconductive layer formed on the surface thereof. The photoconductive layer is formed by uniformly applying a charge generating layer of 0.5 $\mu$m thick and then uniformly applying a charge transfer layer of 34 $\mu$m thick over the charge generating layer. A reference numeral 2 designates a main charger made up of a scorotoron charger with a screen grid. A reference numeral 3 designates an optical system for illuminating the document placed on the original table and focusing the reflected light on the photoreceptor. A reference numeral 4 designates a developing unit for visualizing the static latent image formed on the photoreceptor with toner. A reference numeral 5 designates a transfer unit which transfers the toner image on the photoreceptor to the copy sheet. The copy paper with the toner image transferred thereto is peeled off from the photoreceptor by separator 6 and introduced to a fixing unit 7 where the toner image is fused and fixed to the sheet and then discharged outside the machine. A reference numeral 9 designates a standard white plate having a non-reflective portion as a part thereof and 8 designates a blank lamp. A latent image of a toner patch is formed by exposing the image of the standard white plate 9 onto the photoreceptor surface as the blank lamp 8 is selectively turned on in accordance with prescribed timing. The thus formed latent image is developed by the developing unit 4 into a toner patch. A reference numeral 10 designates a photosensor which detects the density of the toner patch on the photoreceptor. A reference numerals 11 designates a temperature and humidity sensor for detecting the temperature and humidity inside the copier. A reference numeral 12 designates a toner density sensor which detects the toner density of the developer inside the developing unit 4 based on the inductance.

Figure 8:
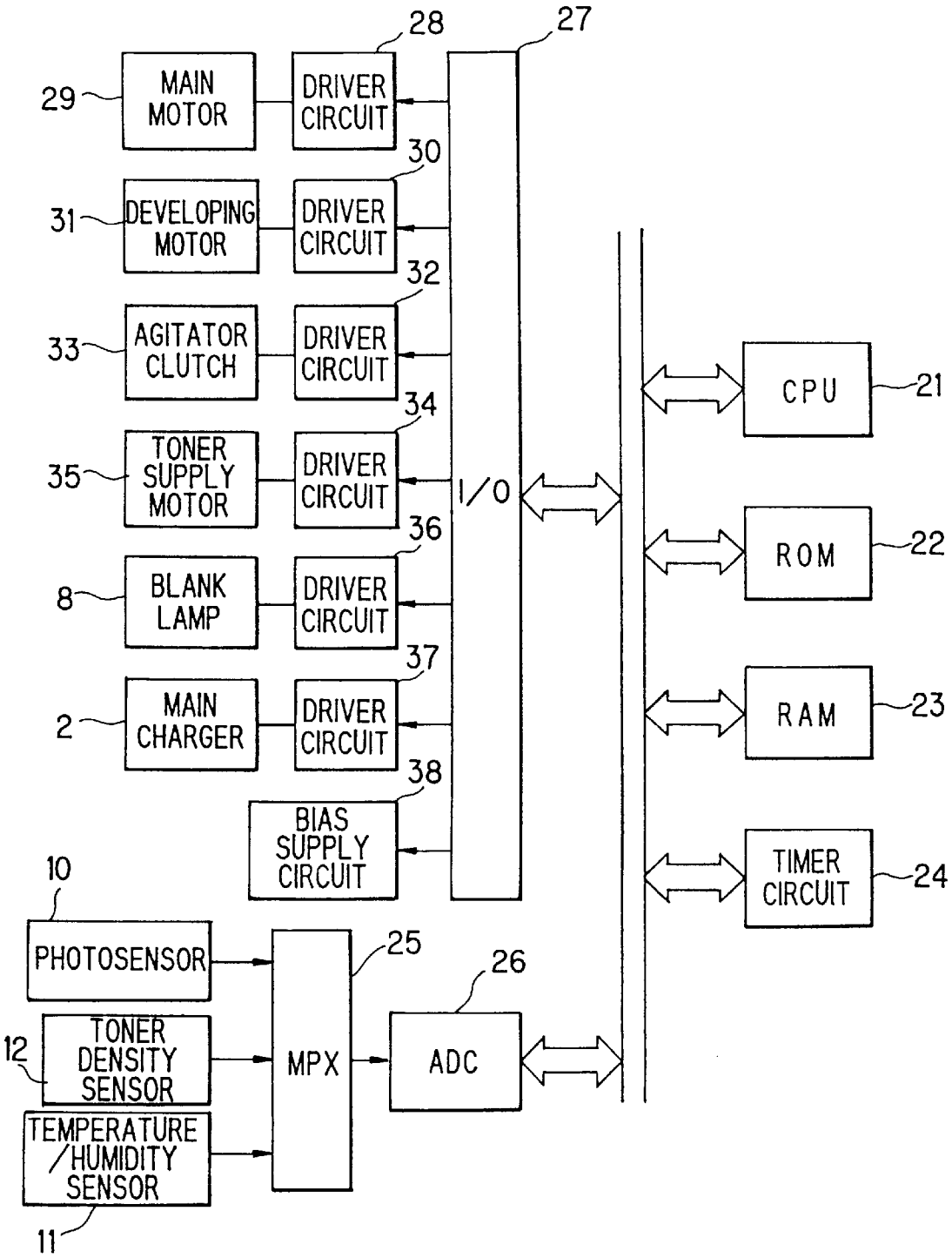
FIG. 8 is a block diagram showing a configuration of a controller of a copier.

FIG. 8 is a block diagram showing a configuration of a controller of the copier. A CPU 21 executes a prescribed program previously written in a ROM 22 to perform a series of processing described hereinbelow. A RAM 23 is used for working areas for the processing. A timer circuit 24 effects time-counting operations independently of the process by the CPU 21. The CPU 21 resets the timer circuit 24 at a desired timing and reads the counted value. An AD converter 26 converts into digital data any of the output signal from the optical sensor 10, the output signal from the toner density sensor 12 or the output signal from the temperature and humidity sensor 11, which is selected by a multiplexer 25. The CPU 21 switches over the multiplexer 25 at a necessary timing and reads the output value from the A/D converter 26. A main motor 29 is a driving source of driving the portions such as the photoreceptor, the original table, the transfer system of copy paper; a developing motor 31 is a driving source of rotary parts in the developing unit; and an agitator clutch 33 is a mechanism of effecting the switching operation of whether the rotation of the developing motor 31 is transmitted to agitator blades. A toner supply motor 35 is a driving source of supplying toner into the developing vessel of the driving unit. The blank lamp 8 and the main charger 2 are included as already described with reference to FIG. 7. A bias supply circuit 38 supplies a developing bias voltage to the developing unit. The CPU 21 controls these peripheral devices through an I/O port 27 as well as a driver circuits 28, 30, 32 ,34, 36 or 37.

Figure 10:
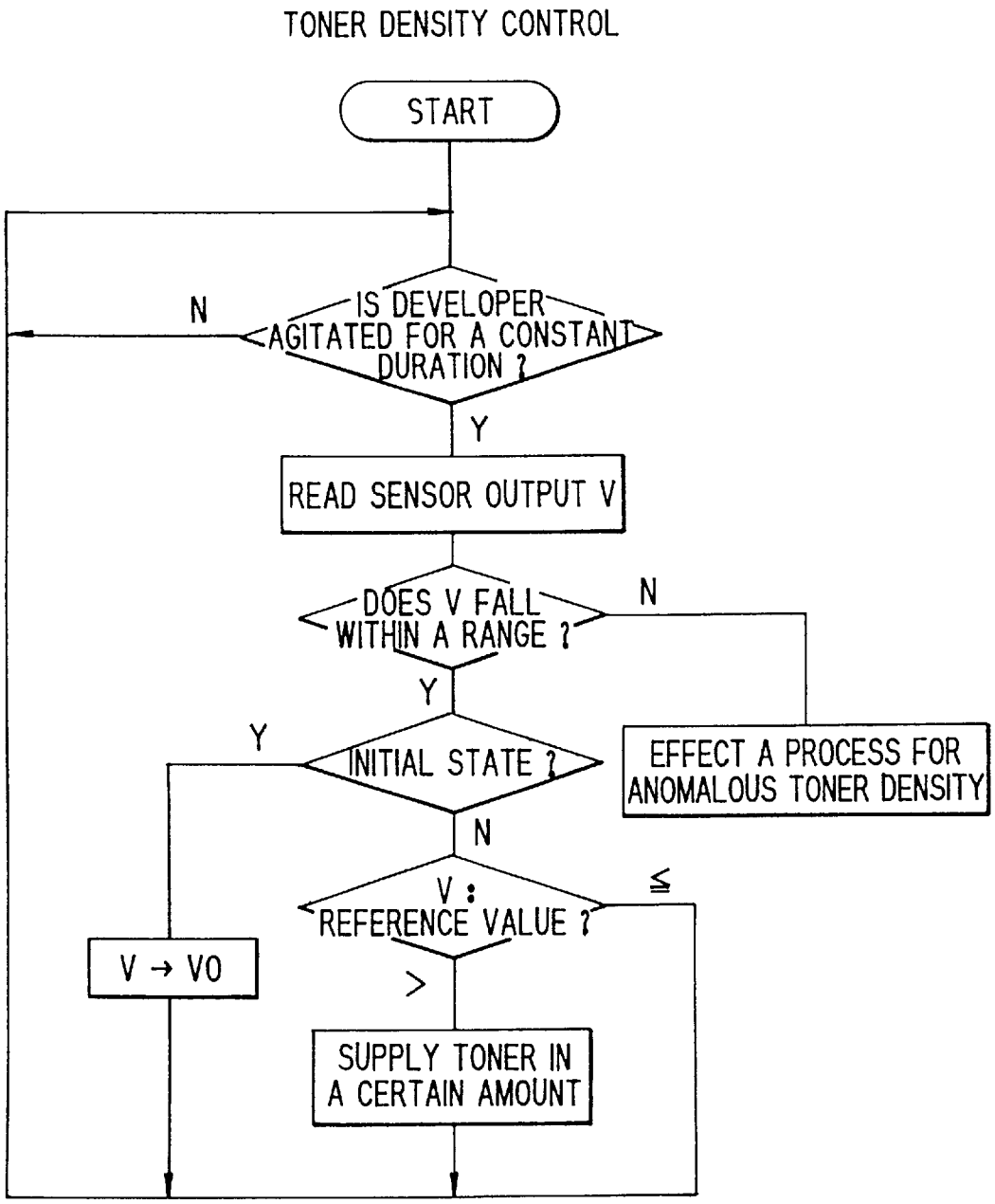
FIG. 10 is a flowchart showing the order of procedures for automatically controlling toner density in a developer.

FIG. 10 is a flowchart showing the order of procedures for controlling the toner density of the developer based on the output from the toner density sensor 12. First, a judgment is made on whether the developer has been agitated for a predetermined period of time from when the last toner density control was made. If the judgment is determined to be positive, the output value V from the toner density sensor is read out. Determined then is whether this value V falls within a predetermined range. If this value belongs outside of the range, a treatment for anomalous toner density will be effected. If the output V from the toner density sensor belongs to the predetermined range, another judgment is made as to the state. That is, if the toner density is effected for the first time, for example, immediately after the reset when the developer is replaced, the output value V from the toner density sensor is set at V0 (as an initial reference voltage) and this voltage is stored into the memory. If the operation is determined not to be in the initial condition, the output value V is compared with a reference voltage which is set up in the toner density correcting process to be aforementioned. When the output value V is above the reference voltage, the toner supply motor is activated to supply a predetermined amount of toner to the developing vessel. If V is not more than the reference voltage, toner supply will not be done. The above processing will be repeated whereby the toner density of the developer is controlled so that the output V from the toner density sensor may be equal to the reference voltage.

(First embodiment)

Now, a toner density correction in accordance with a first embodiment of the invention as well as the order of the procedures will be described.

Figure 3:
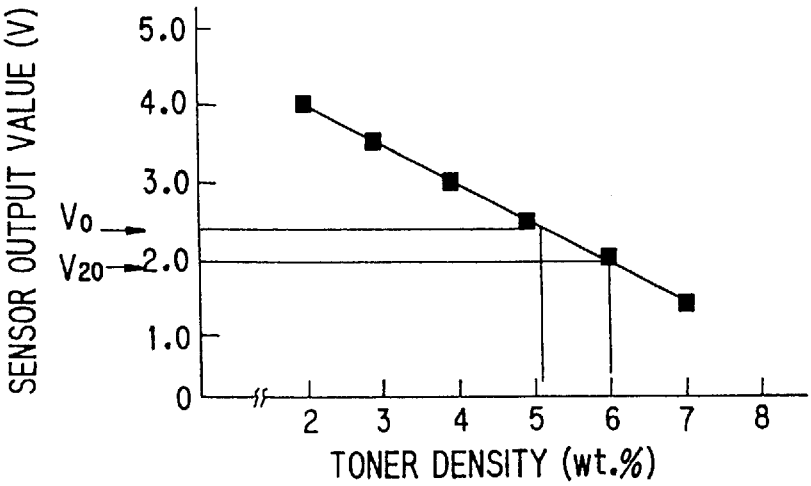
FIG. 3 is a chart showing a relation between toner density of a developer and output from a toner density sensor.

FIG. 9 shows an example of reference voltages used upon the above toner density control. In this table, the total rotating time is a total rotating time as to the main motor and indicates the agitation total of the invention. Although no particular mention is made in the flowchart, the controller measures the total rotating time of the main motor and effects a process to determine a CNT value shown in FIG. 9. Also the controller changes the reference voltage in accordance with the total rotating time of the developer for the purpose of toner density correcting process to be aftermentioned. As mentioned above, if, for example, the output voltage from the toner density sensor immediately after the replacement of the developer is 2.375 V, this value is set as the initial reference voltage V0 and stored in the memory. If the total rotating time belongs to a range of 0 to 99 seconds (the CNT value for this range is set at 0), the reference voltage is kept at V0. Then, if the total rotating time, for example, belongs to 100 to 199 seconds (CNT=1), the reference voltage is set at V1=2.355 V, which is 0.02 V lower than V0. Similarly, if for example the total rotating time is in a range of 2,000 to 19,999 seconds (CNT=20), the reference voltage is set at 1.975 V (V20), which is 0.02 V lower than V19. Thus, before 2,000 seconds, the reference voltage is reduced,by example, by 0.02 V every time the total rotating time increases by 100 seconds. In this way, as the reference voltage is varied in association with the agitating time of the developer, the toner density control shown in FIG. 10 is repeatedly done, whereby the output value from the toner density sensor as following the reference voltage, varies stepwise from V0 to V20 as the total rotating time increases. As shown in FIG. 3, the apparent toner density can be corrected from about 6 wt. % to about 5 wt. %.

Figure 5:
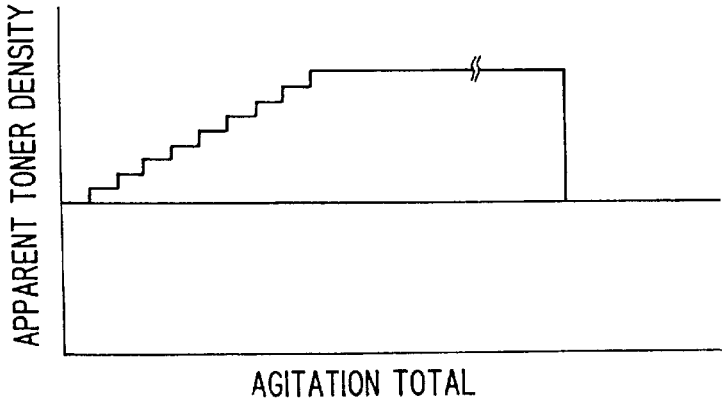
FIG. 5 is a chart showing a relation between agitation total and apparent toner density.
Figure 15:
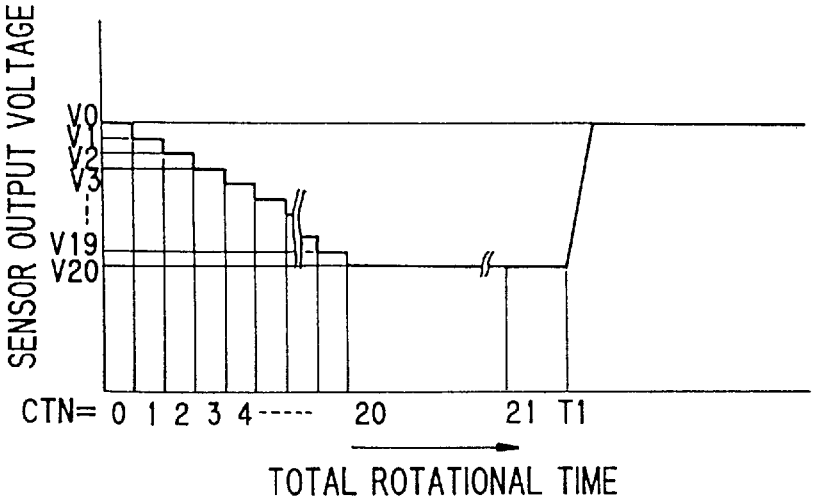
FIG. 15 is a chart showing a relation between total rotational time and output voltages from a toner density sensor.

FIG. 15 shows variations of the output voltage from the density sensor in accordance with the above control. As shown in the figure, the output from the toner density sensor varies stepwise from V0 to V20 with the augment of the total rotating time. By this operation, the apparent toner density gradually increases as shown in FIG. 5, whereby the lowering of the image density occurring at the initial stage where the developer is just started to be used can be corrected.

Figure 11:
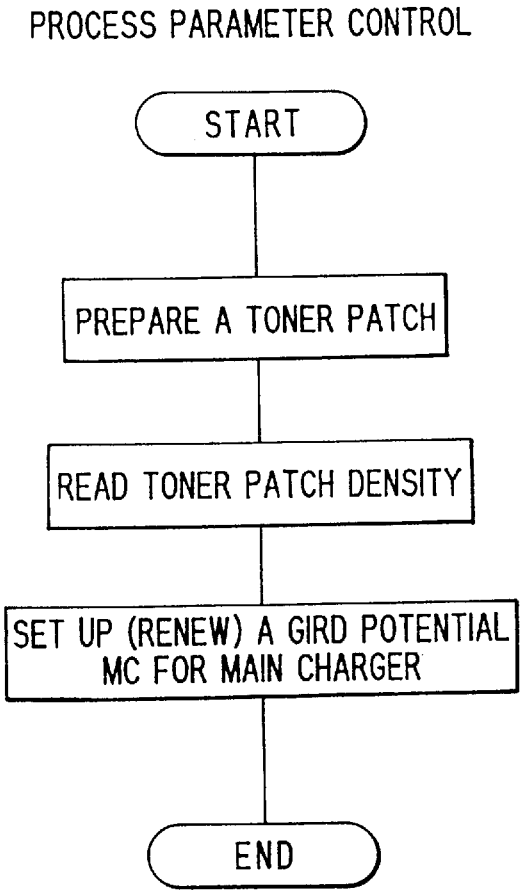
FIG. 11 is a flowchart showing the order of procedures for automatically controlling the applied voltage to the main charger.

FIG. 11 is a flowchart showing the order of procedures of a process parameter control for setting up process parameters which is practically independent from the above toner density control. Initially, a latent image for creating a toner patch is formed on the photoreceptor surface. This latent image is developed into a toner patch. Subsequently, the digital value outputted from the photosensor 10 is picked up as its toner patch density. Then a grid potential MC of the main charger 2 is set up so that the toner patch density may be equal to a previously determined density value. The process control shown in FIG. 11 is repeatedly done at predetermined intervals as will be stated hereinafter. Thus the surface potential of the photoreceptor is determined by the above MC set up as above.

Figure 12:
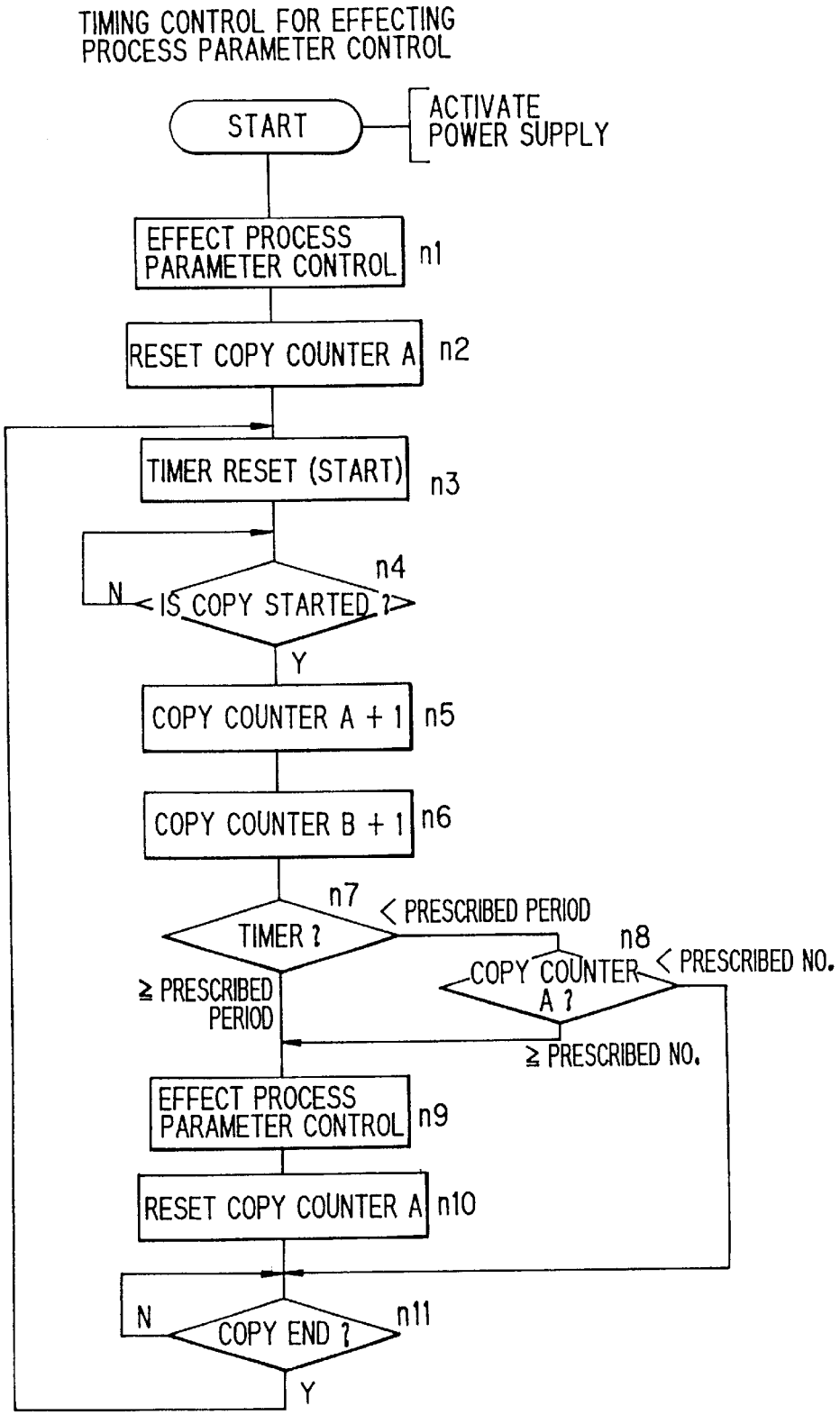
FIG. 12 is a flowchart showing the order of procedures for controlling timing for effecting the procedures shown in FIG. 11.

FIG. 12 is a flowchart showing the order of procedures for controlling the operation timing of the process parameter control shown in FIG. 11. In the beginning, the above process parameter control is effected when the apparatus is energized, and a copy counter A for counting the number of copies is reset (n1→n2). Subsequently, the timer circuit 24 is reset and the timer is started (n3). The start of a copying operation is waited for (n4). When a copying operation starts, the copy counter A is incremented by 1 while another copy counter B to be aftermentioned also is incremented by 1 (n5→n6). Then the value of the timer at the time of start of the copying operation is compared with a reference value, and if the value of the timer does not reach the reference value, a judgment is made on whether the value of the copy counter A is equal to or above a prescribed number. If the sum of the value of the counter A and the number of copies to be made in the current copying operation exceeds the prescribed number, the above process parameter control is effected prior to the actual copying operation (at the time of the pre-rotation) (n7→n8→n9). Thereafter the copy counter A is reset and the end of the copying operation is waited for (n10→n11). Thus one round of the process parameter control shown in FIG. 11 is performed whenever copies of the prescribed number have been made. The above timer also measures the standby time during which no copying operation has been done. If time longer than a predetermined duration has elapsed without any operation when a next copying operation is made, the process; parameter control is effected regardless of whether the number of copies has not reached the prescribed number at; that time (n4→n5→n6→n7→n9).

Figure 13:
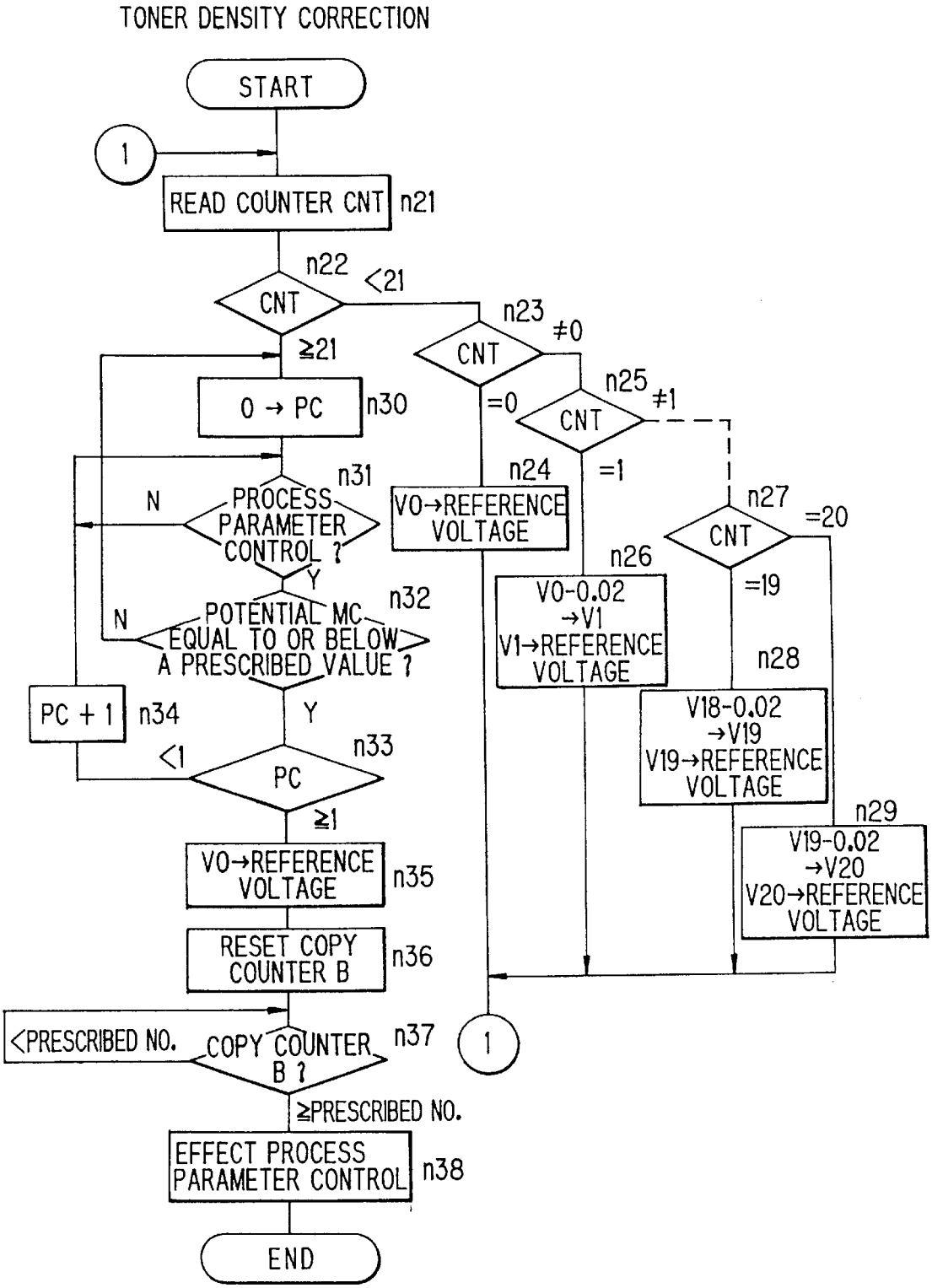
FIG. 13 is a flowchart showing the order of procedures for correcting toner density.

FIG. 13 is a flowchart showing the order of the toner density correcting process. Initially, the counter CNT value shown in FIG. 9 is detected (n21). If the CNT value is zero, the voltage V0 shown in FIG. 9 is set up as the reference voltage (n23→n24). If CNT=1, V1 is set up as the reference voltage (n25→n26). Similarly, if CNT=20, V20 is set up as the reference voltage (n29). Thereafter, if the total rotating time increases and the counter CNT value reaches 21, a loop counter PC is reset and next activation of the process parameter control is waited for (n22→n30→n31). The process parameter control is done at the timing shown in FIG. 12. When the process control is effected, the grid voltage MC of the main charger is compared with a prescribed value (n32). If developing performance of the developer is still low, the surface potential of the photoreceptor or the MC value is increased to maintain the density of the toner patch at a prescribed value. On the other hand, if MC is still beyond the prescribed value, the loop counter PC is reset and next activation of the process parameter control is waited (n32→n30). Thereafter, as the agitation total of the developer increases, developing performance of the developer is improved. As a result, the grid voltage MC gradually decreases as some or several rounds of the process parameter control shown in FIG. 11 have been done. If the MC, determined by the process control take a value equal to or below the predetermined value twice in succession, it is judged that it is no longer necessary to correct the toner density and the toner density correction tends to cause an overcorrected state. Accordingly, the reference voltage is set at V0 after this detection (n32→n33→n34→n31→n32→n33→n35). Subsequently, the copy counter B as a counter for counting the number of copies to be made from this point of time is reset and the operation will be waited until the copy counter B counts up to a predetermined number (n36→n37). The copy counter B is incremented in the flow shown in FIG. 12. When copies of the predetermined number have been made, the process parameter control shown in FIG. 11 is forcibly effected, independently of the timing shown in FIG. 12 (n38). By the above operation, the reference voltage at the time of T1 is set at V0 as shown in FIG. 15 and the toner supply to the developing vessel is stopped or lowered in quantity and the output from toner density sensor as following this setting, rises up to V0.

(Second embodiment)

Figure 14:
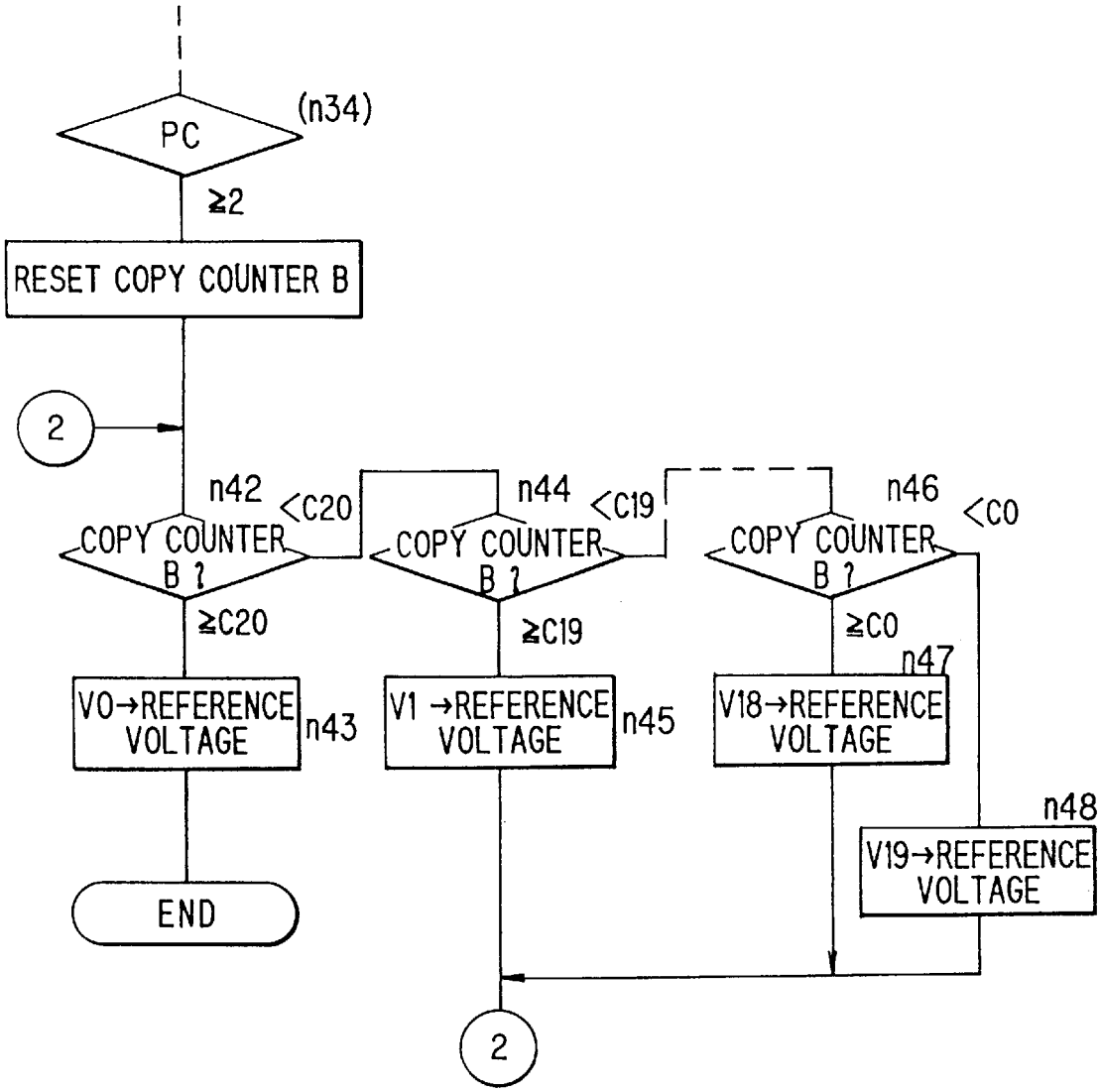
FIG. 14 is a flowchart showing part of the procedures of toner density correction in accordance with a second embodiment.

Next, FIG. 14 shows part of the procedures of a toner density correcting flow in accordance with a second embodiment. The prior process to the procedures shown in FIG. 14 is the same with that of steps n21 through n34 in FIG. 13. That is, when the toner density correction is canceled after developing performance of the developer has been improved, the copy counter B for counting the number of copies from the point of time is reset and thereafter the reference voltage is determined based on the value of the copy counter B. For example, the reference voltage is set and kept at the voltage V19 shown in FIG. 9 until the value of the copy counter B reaches a predetermined number C0 (n46→n48). When for example, the value of the copy counter B exceeds the predetermined number C0, the reference voltage is set at the voltage V18 shown in FIG. 9 (n47). If for example, the value of the copy counter B exceeds the predetermined number C19, the reference voltage is set at the voltage V1 shown in FIG. 9 (n44→n45). Further, if the number of copy increases and the value of the copy counter B becomes equal or above a predetermined number C20, the reference voltage is set at V0 (n42→n43). In this way, since the reference voltage is varied in accordance with the augment of the copy number while the toner density control shown in FIG. 10 is repeatedly done in the course of the cancellation of the toner density correction, the output from the toner density sensor, as following the reference voltage, varies stepwise from V20 to V0 with the augment of the number of copies.

Figure 6:
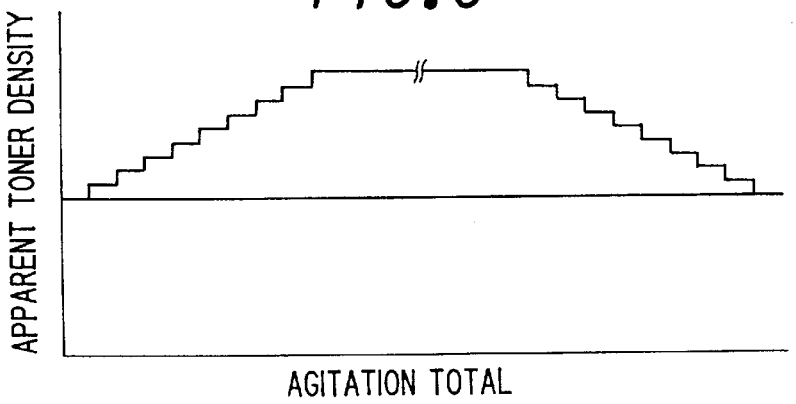
FIG. 6 is a chart showing a relation between agitation total and apparent toner density.
Figure 16:
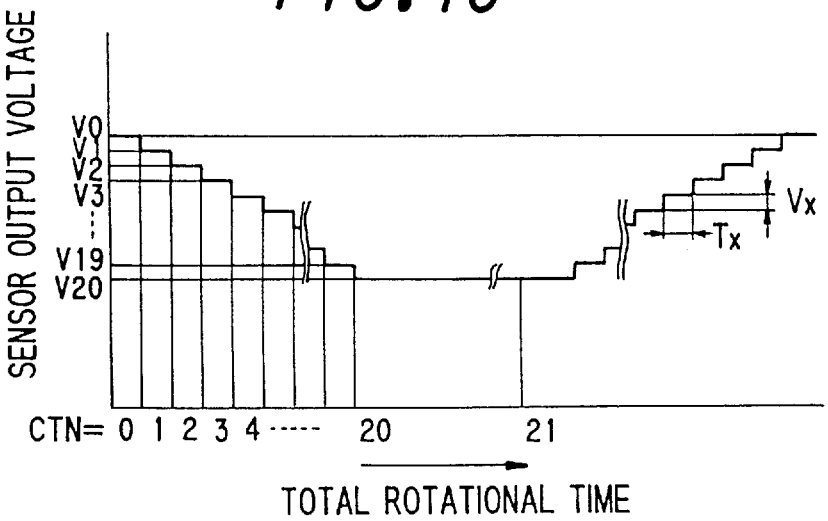
FIG. 16 is a chart showing a relation between total rotational time and output voltages from a toner density sensor; 7

FIG. 16 shows variations of the output voltage from the toner density sensor by the above control. As seen, the output from the toner density sensor varies stepwise from V20 to V0 with the augment of the number of copies. This control allows the apparent toner density to gradually lower as shown in FIG. 6, whereby change of the characteristic of electrification of the developer is regulated so that it is possible to create stabilized images before and after the cancellation of the toner density correction.

(Third embodiment)

Figure 1:
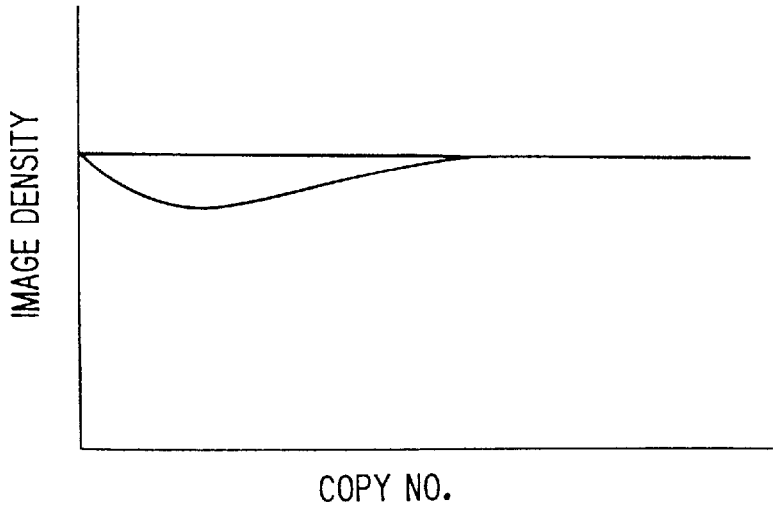
FIG. 1 is a chart showing a tendency of initial lowering of image density when a virgin developer is used.
Figure 2:
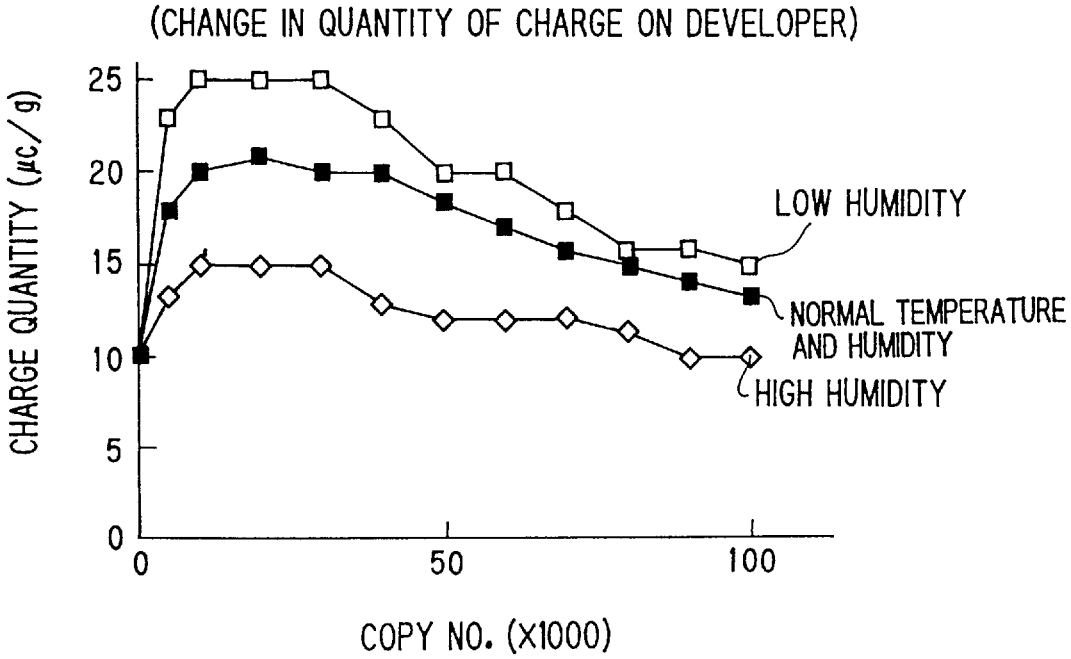
FIG. 2 is a chart showing changing behavior of the charge quantity of a developer.

Next, a configuration of an image forming apparatus in accordance with a third embodiment will be described. In the above examples, the judgment of either continuation or cancel of the toner density correction is made when the total rotating time reaches a predetermined value as shown in FIG. 9. The quantity of charge on the developer changes depending upon the temperature and humidity as shown in FIG. 2. To deal with this, in this third embodiment, timing of the judgment of whether the toner density correction is to be continued or canceled is set up as follows. The total rotating time at CNT 20 shown in FIG. 9 is set up as a standard value for the standard environment, and the total rotating time at CNT20 at the time of high temperature (30° C. or more) or high humidity (70% or more) is set at a half of the standard value, specifically in a range from 2,000 to 9,999 seconds while the total rotating time at CNT20 at the time of low temperature (15° C. or less) or low humidity (35% or less) is set at a double of the standard value, specifically in a range from 2,000 to 39,999 seconds. The other control is effected in the same manner.

(Fourth embodiment)

Next, a configuration of an image forming apparatus in accordance with a fourth embodiment will be described. In the above examples, although the total rotating time of the main motor is associated with the agitation total of the developer, the actual agitation total of the developer varies depending on the use condition of the copier or the average copy number per one operation in the copier. Therefore, in the fourth embodiment, timing of the judgment of whether the toner density correction is to be continued or canceled is changed based on the use condition of the copier. Specifically, the total copy number when CNT=20 as shown in FIG. 9 or when the total rotating time of the main motor has reached 2,000 seconds is assumed to be represented by n, CNT20 and CNT21 are set up on the following conditions:

| L | Setup Time for CNT20 | Setup Time for CNT21 |
|---|---|---|
| L ≧ 0.65 | 2,000 to 29,999 sec. | 30,000 sec. |
| L ≦ 0.25 | 2,000 to 9,999 sec. | 10,000 sec. |

where L=n/2,000. Other than these are the same as shown in FIG. 9.

(Fifth embodiment)

Next, a configuration of an image forming apparatus in accordance with a fifth embodiment will be described. Although in the second embodiment, the cancellation of the toner density correction is effected by counting the total number of copies from the start of the canceling mode and changing the reference voltage for the toner density control stepwise based on the total number of copies thus counted, the quantity of charge on the developer changes depending upon the temperature and humidity as shown in FIG. 2. Therefore, in this fifth embodiment, Tx and Vx shown in FIG. 16 will be changed depending on the conditions as follows:

Standard Environment Mode (to be abbreviated as S.E. mode):
Vx=0.02 V
Tx=100 sec.

High Temperature and Humidity Mode:
Vx=2×(the value in S.E. mode)
Tx=½×(the value in S.E. mode)

Low Temperature and Humidity Mode:
Vx=½×(the value in S.E. mode)
Tx=2×(the value in S.E. mode).

(Sixth embodiment)

Next, a configuration of an image forming apparatus in accordance with a sixth embodiment will be described. Although in the above examples, the cancellation of the toner density correction is effected by counting the total number of copies from the start of the canceling mode and changing the reference voltage for the toner density control stepwise based on the total number of copies thus counted, the actual agitation total of the developer varies depending on the use condition of the copier or the average copy number per one operation in the copier. Therefore, in this sixth embodiment, Tx and Vx shown in FIG. 16 will be changed depending on the conditions as follows:

When L≧0.65
Vx=½×(the value in S.E; mode)
Tx=2×(the value in S.E. mode)

When L≦0.25
Vx=2×(the value in S.E. mode)
Tx=½×(the value in S.E. mode), where L=n/2,000 and Vx=0.02 V and Tx=100 sec. at the standard environment mode.

(Seventh embodiment)

Figure 4:
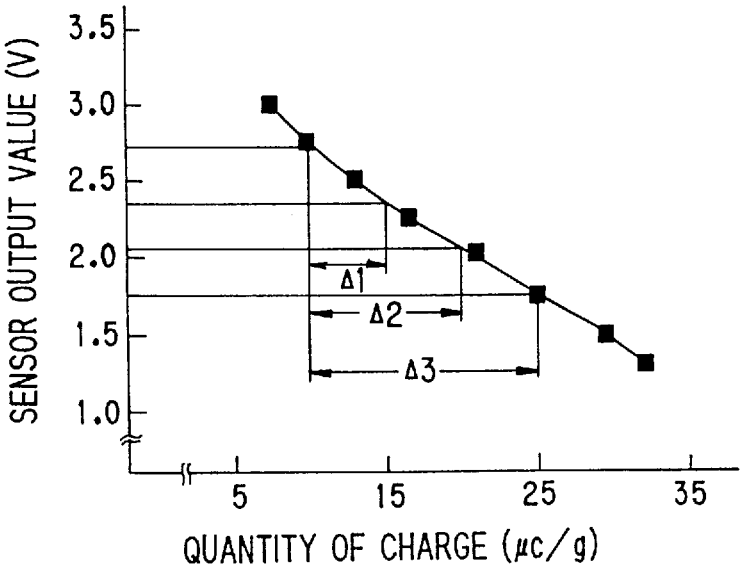
FIG. 4 is a chart showing a relation between the quantity of charge on a developer and output from a toner density sensor.

Next, a configuration of an image forming apparatus in accordance with a seventh embodiment will be described. Although in the first embodiment, the correction is made by varying the standard voltage by the step of 0.02 v every time the count value CNT of the total rotating time increases by 1. The quantity of charge on the developer, however, changes depending upon the temperature and humidity as shown in FIG. 2. As shown in FIG. 4, when the deviations of the charge quantity at the high temperature and humidity environment, the normal temperature and humidity environment, and the low temperature and humidity environment are represented by Δ1, Δ2 and Δ3, respectively, the decreasing amounts of the output voltage from the toner density sensor are about 0.33 V at the high temperature and humidity environment, about 0.66 V at the normal temperature and humidity environment, and about 1.0 V at the low temperature and humidity environment. Therefore, in the seventh embodiment the reference voltage is changed in accordance with the temperature and humidity as follows:

when high temperature and humidity is detected:
the reference voltage is changed by 0.01 V as CNT increases by 1;

when low temperature and humidity is detected:
the reference voltage is changed by 0.03 V as CNT increases by 1.

Although in the first embodiment, the process parameter control is executed when the apparatus is energized, this execution of the process parameter control is not requisite. It is also possible to effect one round of the process parameter control shown in FIG. 11 by temporarily interrupting the copying operation when certain conditions are satisfied during the copying operation and judging developing performance of the developer based on the grid voltage of the main charger set up by the process parameter control.

In the above embodiment, the grid potential of the main charger is set up so that the toner patch density may be equal to a previously determined value by the process parameter control while developing performance of the developer is detected based on the variation of the grid potential of the main charger. Similarly, a variation of the above embodiment can be constructed by setting up the bias potential applied to the developing unit so that the toner patch density may be equal to a target value and detecting developing performance of the developer based on the change of the bias potential.

In accordance with the image forming apparatuses of the embodiments described heretofore, the lowering of the image density at the starting stage of the developer is corrected while the toner density correction is canceled before the overcorrection occurs so that apparent toner density is restored to the original value at the time the correction is not made. As a result, it is possible to improve the quality of image and prevent the pollution of the machine inside due to toner scattering.

In accordance with the foregoing image apparatuses, when the toner density correction is to be canceled as the agitation total of the developer increases, the change of electrification characteristics of the developer is regulated. Therefore it is possible to obtain stabilized images before and after the cancellation of the toner density correction.

Further, in accordance with the foregoing image forming apparatuses, it is possible to attain stabilized image forming with appropriate process parameters as soon as the toner density correction is canceled as the agitation total of the developer has been increased.

(Eighth embodiment)

Figure 18:
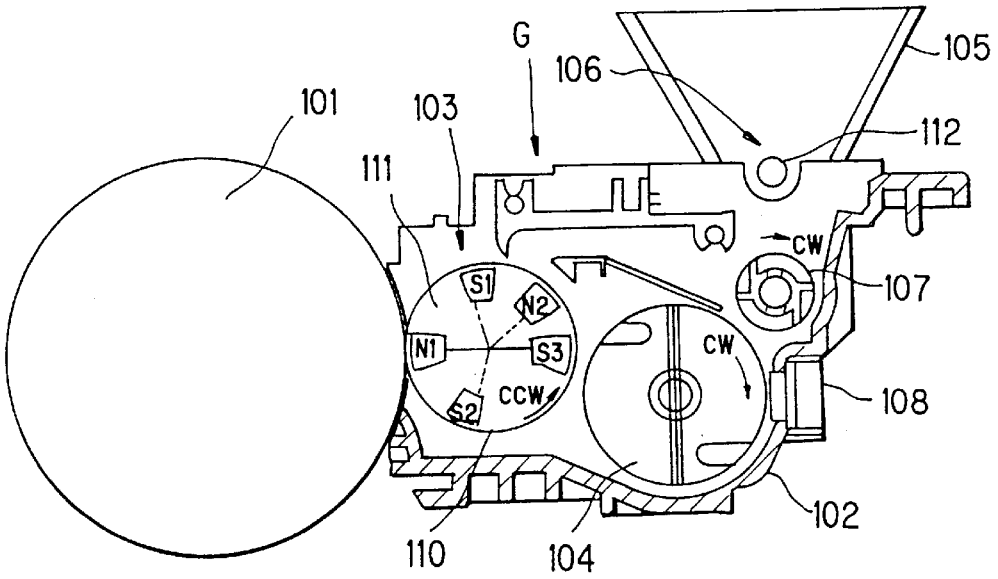
FIG. 18 is a structural view showing a developing unit.

Next, FIG. 18 shows a configuration of a developing unit used in a copier, laser printer or the like in accordance with an eighth embodiment of the invention. In FIG. 18, G designates a developing unit and 101 designates a drum-shaped photoreceptor. The developing unit G includes a developing vessel 102, a developing roller 103 disposed opposite the photoreceptor for developing the static latent image formed on the photoreceptor 101 with a two-component developer consisting of toner and carriers, an agitating roller 104 for agitating the developer in the developing vessel 102, a toner hopper 105 attached on the top of the developing vessel 102 for storing toner to be supplied to the developing vessel 102, a toner supplying portion 106 disposed at the bottom of the toner hopper 105 for supplying the toner to the developing vessel 102, an agitator 107 for conveying the supplied toner so as to uniformly be mixed with the developer inside the developing vessel 102, and a toner density detector 108 disposed opposite the agitating roller 105 in the lower part of the developing vessel 102 for detecting the toner density of the developer.

The developing roller 103 comprises a non-magnetic sleeve 110 which is rotated counterclockwise and magnet body 111 fitted inside the sleeve 110. The magnet body 111 has a main pole named N1-pole which is fixed opposite to the developing nip formed with the photoreceptor 101. The toner supplying portion 106 comprises a toner supplying roller 112, a toner supplying motor 113 for rotating the toner supplying roller 112. The toner density detector 108 includes a toner density sensor which detects the toner density by measuring change in magnetic permeability to detect the change of the apparent volume density of the developer.

Figure 19:
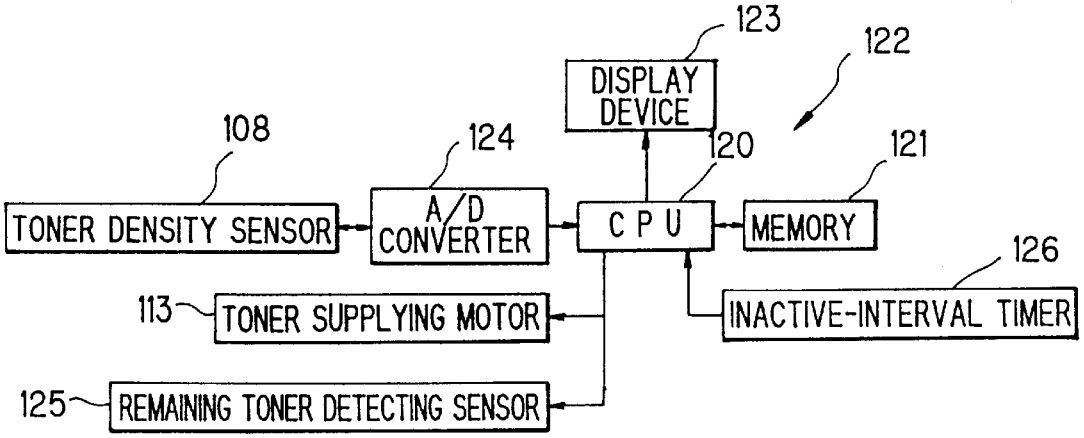
FIG. 19 is a diagram showing a control block for a copier or laser printer.

Further, as shown in FIG. 19, the copier or laser printer includes a controller 122 of a microcomputer composed of a CPU 120 and a memory portion (ROMs and RAMs) 121 for effecting the image forming process. Connected to the CPU 120 are a display device 123 of a display panel etc., the toner density sensor 108 via an A/D converter 124, the toner supplying motor 113, a remaining toner detecting sensor 125 for detecting the remaining amount of toner in the toner hopper 105, an inactive-interval timer 126 for measuring the inactive interval of time from the last operation end of the developing unit G to a next operation start thereof or the time from the stoppage of an unillustrated driving motor for the agitating roller 105 to the start of driving thereof.

The controller 122 has the following functions: a supplying function can supply toner to the developing vessel 102 by driving the toner supplying motor 113 until the output value (output voltage) from the toner density sensor 108 reaches a previously determined reference value (reference voltage); an inactive-interval measuring function can measure the time from the last operation end of the developing unit G to a next operation start thereof or the time from the end of the last agitation of the developer to the start of next agitation by operating the inactive-interval timer 126; and a toner supply controlling function can prohibit toner supply to be effected by the toner supplying portion 106 for a constant duration from the activation of the developing unit G after an inactive interval which is equal to or longer than a predetermined period of time. The toner supply controlling function can prohibit toner supply when the inactive interval is equal to or longer than a predetermined period of time, by setting the reference value for the toner density sensor 108 at its maximum value during a constant duration so as to allow the output value from the toner density sensor 108 not to be higher than the reference value. Here, in order to prohibit toner supply it is also possible to stop the driving of the toner supplying motor 113 for a constant period of time.

In the above configuration, as copying is started, the sleeve 110 of the developing roller 103 and the agitating roller 104 rotate so as to agitate the developer and convey the toner on the sleeve 110 to the developing nip facing the photoreceptor 101 where toner particles adhere to the static latent image on the photoreceptor 101.

As the development is being carried out, the toner inside the developing vessel 102 is consumed and thus the toner density decreases. With this lowering of the toner density, the output value from the toner density sensor 108 increases and exceeds the reference value. In response to the excess, the toner supplying portion 106 effects toner supply, and the thus supplied toner is uniformly mixed with the developer in the developing vessel 102 by the rotation of the agitator 107. Toner supply is continued until the output value from the toner density sensor 108 decreases to the reference value.

Figure 20:
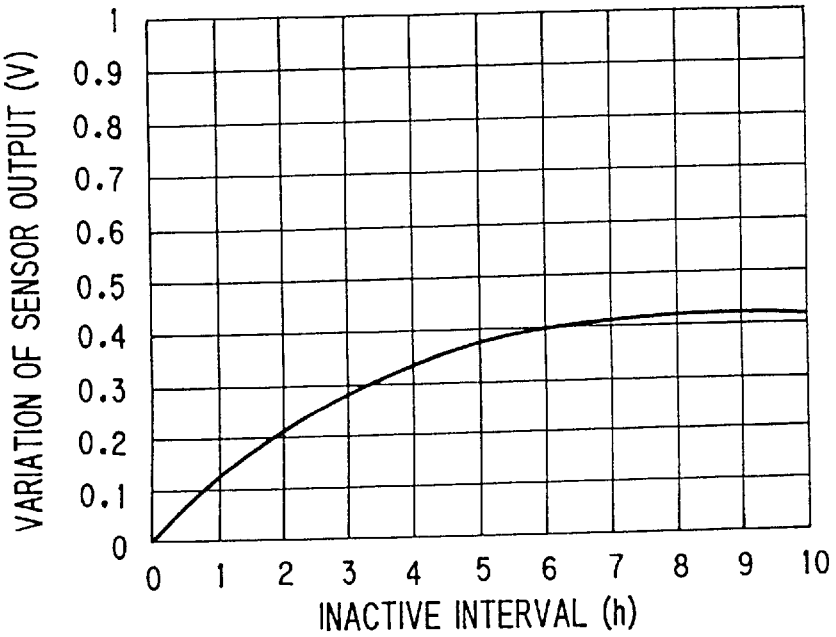
FIG. 20 is a graph showing variations of the output from a toner density sensor, plotted with the passage of the inactive interval.

As the copying operation is complete, the rotation of the agitating roller 104 etc., of the developing unit G stops and the developer is left in an inactive state. The inactive state or the state of being left includes a state in which the developer is not agitated while the power supply is on and a state in which the power supply is off. As the inactive state becomes longer, the developer is pressed down by self-weight, or charges on toner leak and therefore the quantity of charge becomes low. As a result, the output value from the toner density sensor 108 rises with the passage of time in the inactive state and becomes leveled off after a certain period of time (six hours or more in FIG. 20).

Figure 21:
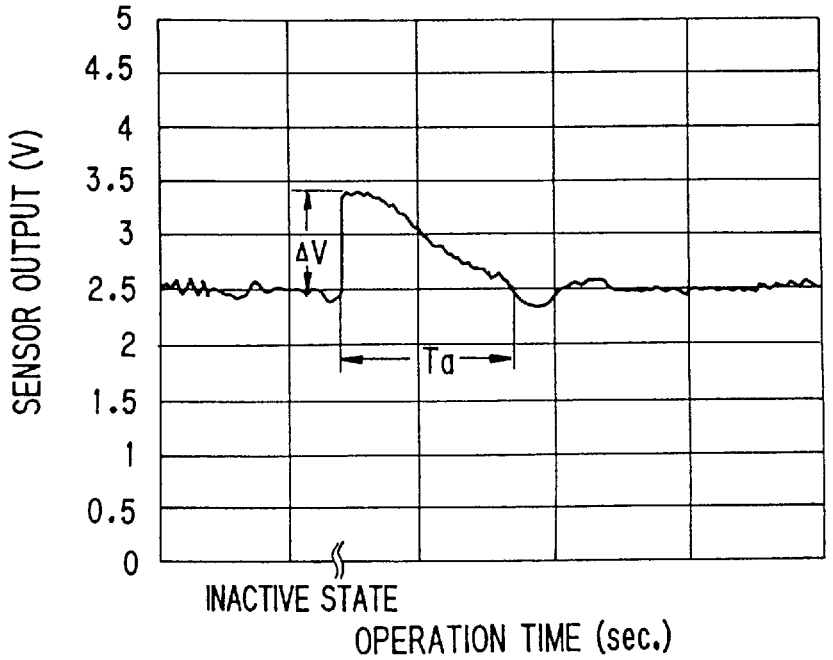
FIG. 21 is a graph showing the behavior of the output from a toner density sensor in operation before a developing unit is put in the inactive state and after the inactive state for a prolonged period of time.

FIG. 21 shows the behavior of the output value from the toner density sensor 108 before the developer is put in the inactive state and throughout the inactive state for a prolonged period of time. The output value from the toner density sensor 108 is adjusted to the reference value (2.5 V) before the inactive state, but rises during the inactive state despite that the actual toner density is unchanged. The variation $\Delta V$ in the sensor output can be recovered to the output value as it is before the inactive operation, by rotating the agitating roller 104 for Ta sec. to agitate the developer.

Figure 22:
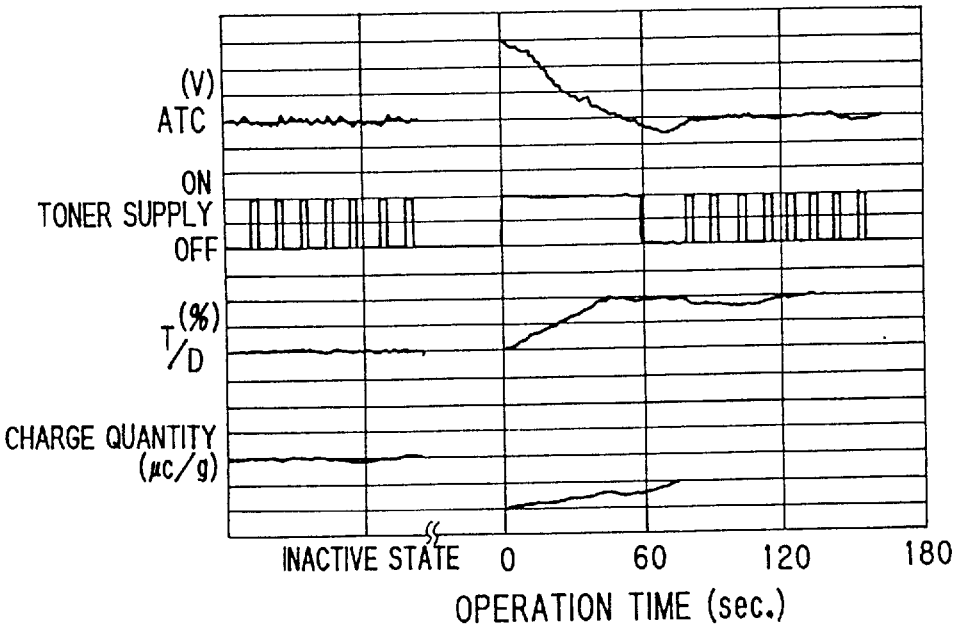
FIG. 22 is a graph showing variations of the output from a toner density sensor, toner density and quantity of charge when toner supply is effected for a developing unit in operation after the inactive interval.

In the above state, if toner supply is provided in accordance with the output value from the toner density sensor 108 as used to be done, an excessive amount of toner is supplied, the toner density (T/D) rises and generation of charges produced by friction becomes insufficient and therefore the average quantity of charge on the developer lowers, as seen in FIG. 22. In the figure, ATC indicates the output from the toner density sensor 108. As a result, there occur various problems that background foggy and thickening of characters and fine lines are generated in copy images and the amount of scattering toner also increases.

Figure 17:
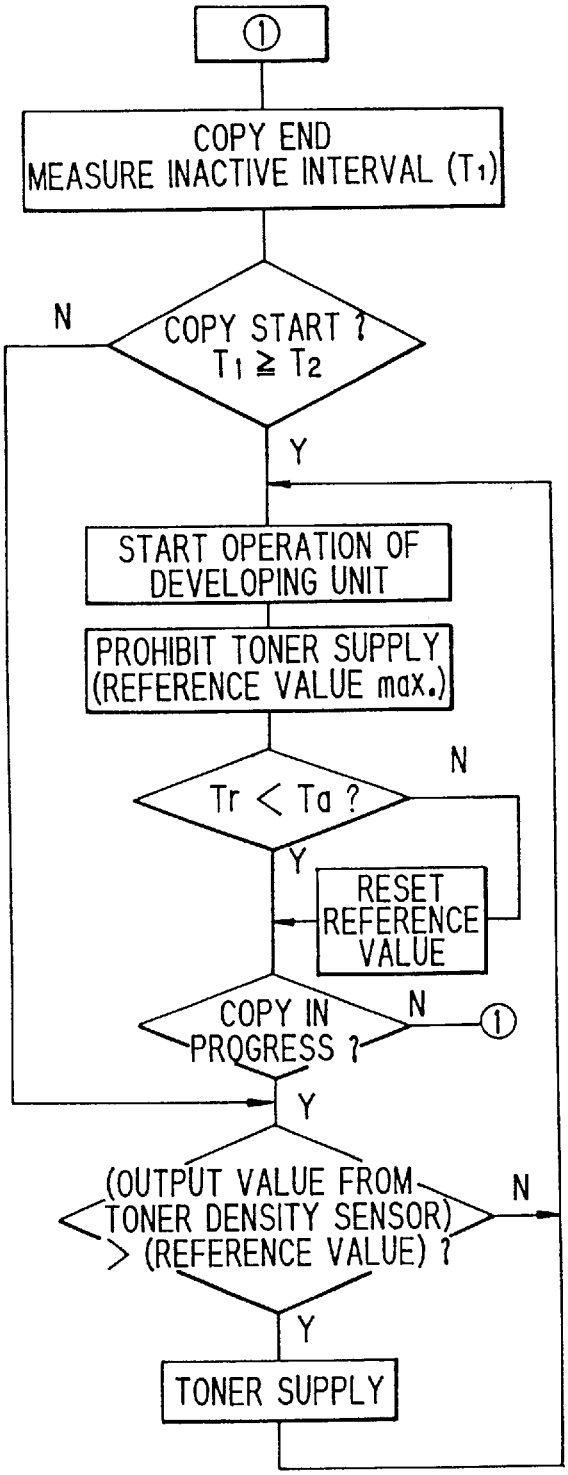
FIG. 17 is a flowchart of toner supplying control after an inactive interval in accordance with an eighth embodiment of the invention.

In this embodiment, as shown in FIG. 17, the inactive-interval timer 126 is activated from the end of agitation of the developer at the end of copying or at the time of deactivating the apparatus in order to measure an inactive-interval ($T_1$) up to the start of agitation of the developer at a next copying operation or at the time of energizing the apparatus.

As the developing unit G is activated, specifically, when a copying operation is started or when the apparatus is energized and then the agitating roller 104 begins to rotate and agitate the developer, it is judged if the inactive interval ($T_1$) is equal to or greater than a predetermined time ($T_\alpha$). If the judgment is affirmative, toner supply to be effected by the toner supplying portion 106 is prohibited until the output value from the toner density sensor 108 recovers itself to a value in conformity with the actual toner density. This prohibition of toner supply is done by setting up the reference value at the maximum for a previously set up constant duration Ta so that the output value from the toner density sensor 108 may not be higher than the reference value. As the operation time (designated at Tr) of the developing unit G is equal to or greater than the constant duration Ta, the agitation of the developer reaches a sufficient level and the quantity of charge on toner becomes stabilized. At this point, the reference value is reset to a predetermined value so that normal toner supplying control is made. In contrast, if the inactive interval ($T_1$) is shorter than the predetermined time ($T_\alpha$), the normal toner supplying operation in conformity with the output value from the toner density sensor 108 is effected from when the developing unit G is activated.

Figure 23:
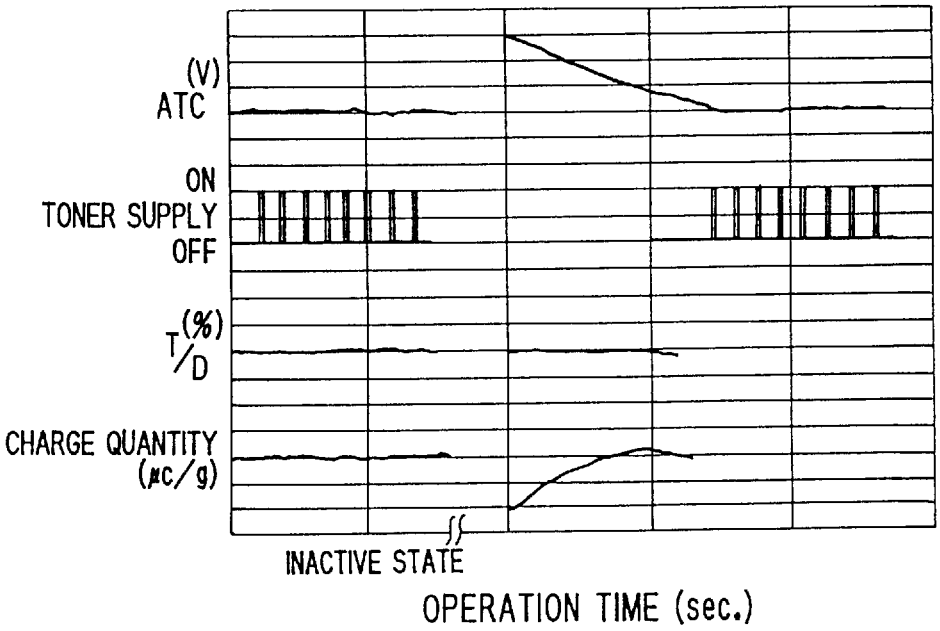
FIG. 23 is a graph showing variations of the output from a toner density sensor, toner density and quantity of charge when toner supply is prohibited for a developing unit in operation after the inactive interval.

FIG. 23 shows variations of the factors in concern with the above operation of the toner supplying control. As seen in FIG. 23, because of the lowering of the quantity of charge after the developer was left in the inactive state, the output value from the toner density sensor 108 rose. Nevertheless, since toner supply was prohibited for a predetermined period of time until the developer has been well agitated, the toner density (T/D) was not affected by the change of the output value from the toner density sensor 108, and could be kept constant and the average quantity of charge on the developer could be stabilized at the appropriate level. Accordingly, it is possible for this developing unit G to prevent generation of background foggy, toner scattering and other defects in copy images.

Further, if for example, the developing unit G is deactivated right after toner supply and therefore the developer has not been agitated sufficiently, the output value from the toner density sensor 108 detected will not represent the actual toner density. Even in such a case, the prohibition of toner supply for a predetermined period of time after the activation of the developing unit G which has been left inactively, allows the developer to be agitated to a sufficient level. Therefore, the inappropriate output value from the toner density sensor 108 at the time of the deactivation of the developing unit before the inactive state can be modified after the inactive state, whereby it is possible to attain more stabilized control of the toner density.

(Ninth embodiment)

In the eighth embodiment, toner supply to be effected by the toner supplying portion 106 is prohibited for a predetermined duration after the activation of the developing unit G if the inactive interval is equal to or longer than a predetermined period of time. However, there may occur some cases where toner supply is needed in practice. Even in such a case, toner will not be supplied for the predetermined duration, and if copy is made during this period, the copy image could be adversely affected due to the shortage of toner.

To avoid the above situation, the controller 122 in a ninth embodiment has a toner supply controlling function which, in place of prohibiting toner supply to be effected by the toner supplying portion 106 for a predetermined duration from the activation of the developing unit G when the inactive interval is equal to or longer than a predetermined period of time, regulates toner supply to be effected by the toner supplying portion 106 by setting up the reference value for the toner density sensor 108 in accordance with a predeterminedly set up correction table classified in association with different inactive intervals.

Figure 24:
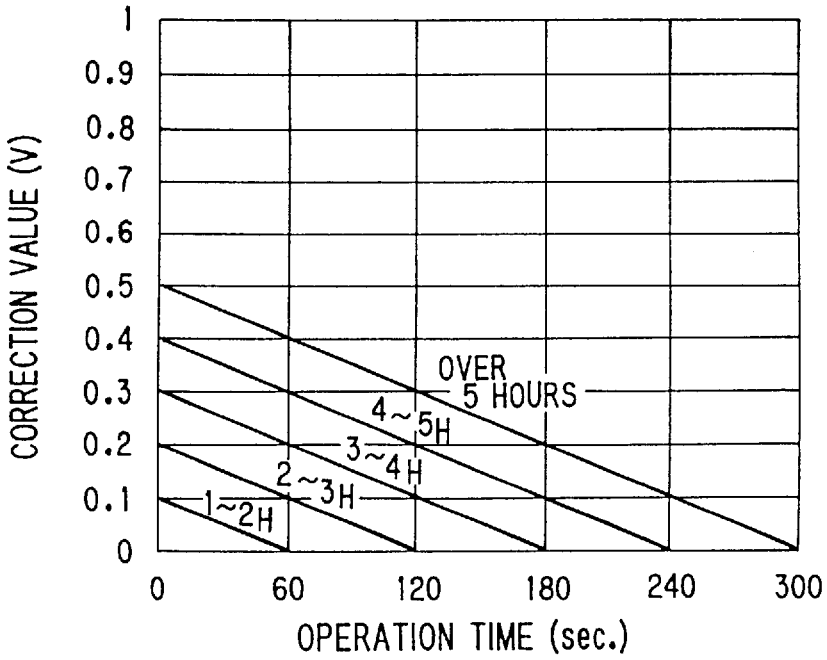
FIG. 24 is a graph showing correction values for correcting a toner density reference value to be set up in association with the operation time of a developing unit for different inactive intervals.

FIG. 24 is a graph showing correction values which are set up in association with the operation time for different inactive intervals. These correction values are to be added to the reference value for the toner density sensor 108. The correction table classified as to different inactive intervals is formed by storing those correction values of the graph into memory. The correction value which is attenuated with the passage of the operation time of the developing unit G can be calculated based on the following formula:

$$\Delta V1 = aTr + bT_1 (\Delta V1 \geqq 0)$$

where ΔV1: a correction value (V); a: a developer characteristic correcting coefficient; Tr: an operation time of the developer G (sec.); b: an inactive-interval coefficient; and $T_1$: an inactive interval (h).

Accordingly, the reference value for the toner density sensor 108 is set up by adding 0.3V to the original reference value if for example, the developer has been left in the inactive state for 3 to 4 hours. As the operation time of the developing unit G increases, the correction value to be added becomes attenuated. For example, the value to be added reduces to 0.2 V after 60 sec., and to 0.1 V after 120 sec., and the reference value is adapted to recover itself to the original reference value after 180 sec. The attenuation of the correction value to be added is set up in view of the fact that the quantity of charge on the developer gradually increases and therefore the output value from the toner density sensor 108 decreases with the augment of the operation time of the developing unit G after the start of agitation of the developer from the activation of the developing unit G.

Figure 25:
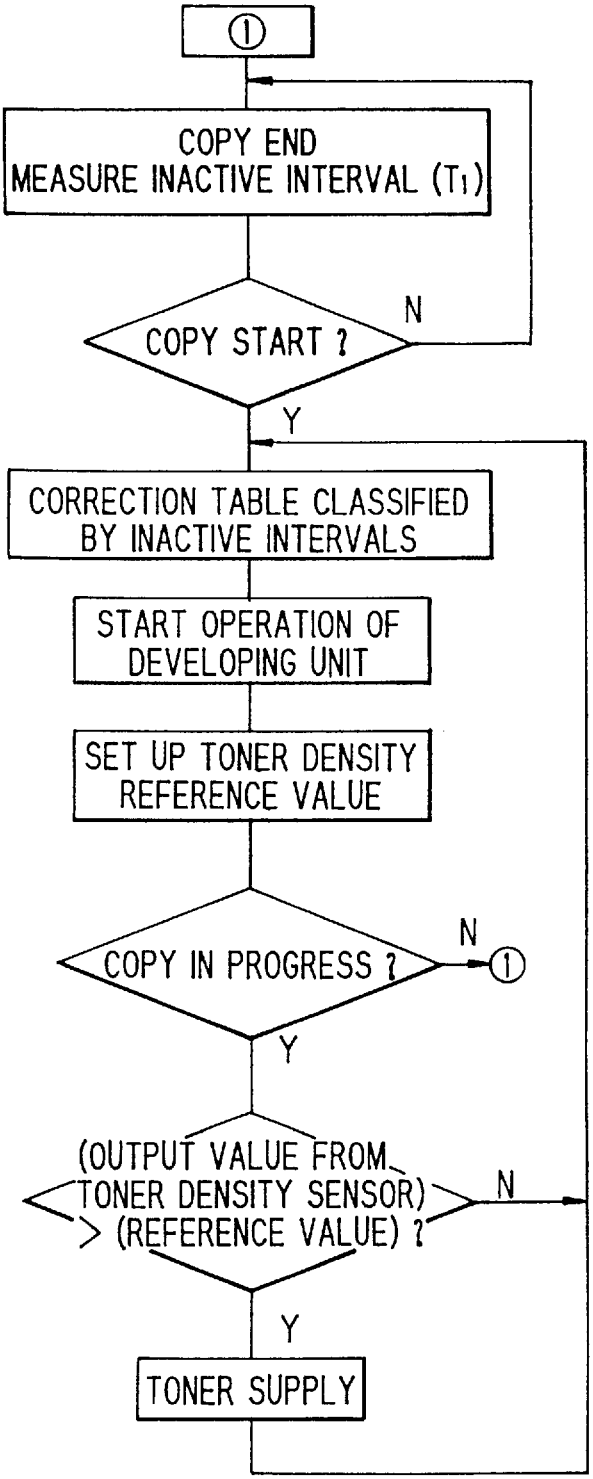
FIG. 25 is a flowchart showing toner supplying control after the inactive time in accordance with a ninth embodiment.

As shown in FIG. 25, the inactive-interval timer 126 is activated from the end of the agitation of the developer at the copy end or when the apparatus is deactivated, in order to measure an inactive interval ($T_1$) up to the start of agitation of the developer at a next copy start or when the apparatus is energized next. When the developing unit G commences to be active, the reference value for the toner density sensor 108 is set up at a specific value in accordance with the correction table classified as to different inactive intervals. Based on the reference value thus set up, the toner supply control is made in accordance with the output value from the toner density sensor 108. Here, other components and operations are the same with those in the eighth embodiment, and the same components with those used in the eighth embodiment are allotted with the same reference numerals.

In this way, the reference value for the toner density sensor 108 in the toner density control after the status of being left or an inactive interval is set up in accordance with the previously determined correction table classified according to different inactive intervals of the developer. That is, the variation of the output value from the toner density sensor 108 after the state of being unused for an inactive interval, is estimated so that it is possible to effect precise control of the toner density in the developer, keep the toner density more preferably and create copy images of high quality, as compared to the eighth embodiment in which toner supply is completely prohibited after the inactive interval.

Further, if for example, the developing unit G is deactivated right after toner supply and therefore the developer has not been agitated sufficiently, the output value from the toner density sensor 108 detected will not represent the actual toner density. Even in such a case, by setting up the reference value for the toner density sensor 108 at a higher value than in the normal operation, in accordance with the correction table classified according to different inactive intervals, it is possible to sufficiently agitate the developer by the time the reference value is reduced to the normal-operation value. Consequently, the inappropriate output value from the toner density sensor 108 before the inactive interval can be modified after the inactive interval, therefore it is possible to attain more stabilized control of the toner density.

(Tenth embodiment)

In the eighth embodiment, the time of being left or inactive interval is determined by measuring the time from the operation end of the developing unit G to the start of a next operation. Since this method requires measurement of time while the apparatus is deactivated, an electric circuit for constantly energizing the inactive-interval timer 126 must be provided resulting in increased cost.

Figure 26:
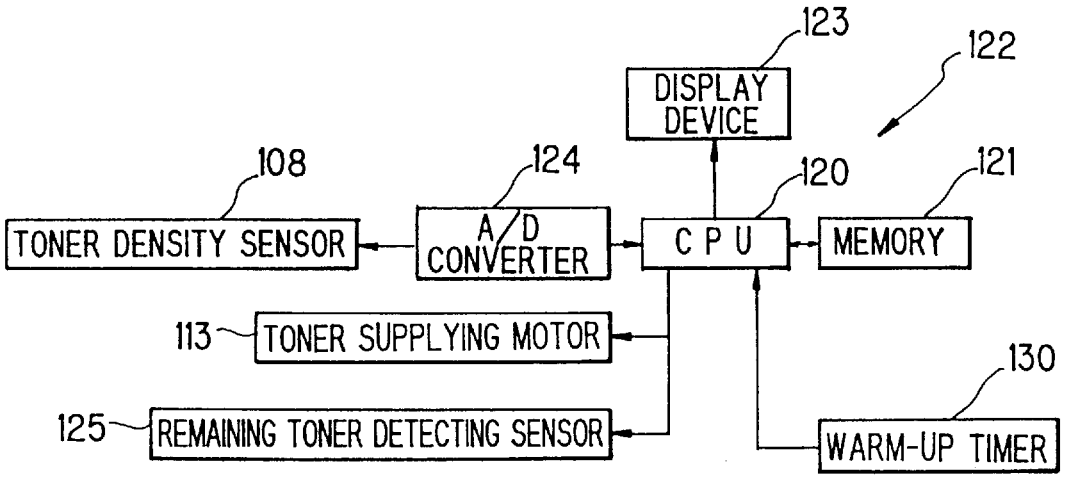
FIG. 26 is a diagram showing a control block for a copier or laser printer in accordance with a tenth embodiment.

To avoid the above situation, in a tenth embodiment, in place of the inactive-interval timer 126, a warm-up timer 130 for measuring a warm-up period from the activation of an unillustrated fixing unit for fusing toner transferred on the recording sheet is provided, as shown in FIG. 26. The controller 122 includes a warm-up measuring function of measuring a warm-up period from the activation of power in the fixing unit to a setup temperature by operating the warm-up timer 130 and a toner supply controlling function of prohibiting toner supply effected by the toner supplying portion 106 for a constant duration from the activation of the developing unit G when the warm-up period measured is equal to or longer than a predetermined period of time .

Since the warm-up period from the activation of power in the fixing unit to a setup temperature is connected with the time of the power supply being off, it is possible to determine the inactive time by measuring the warm-up period.

Figure 27:
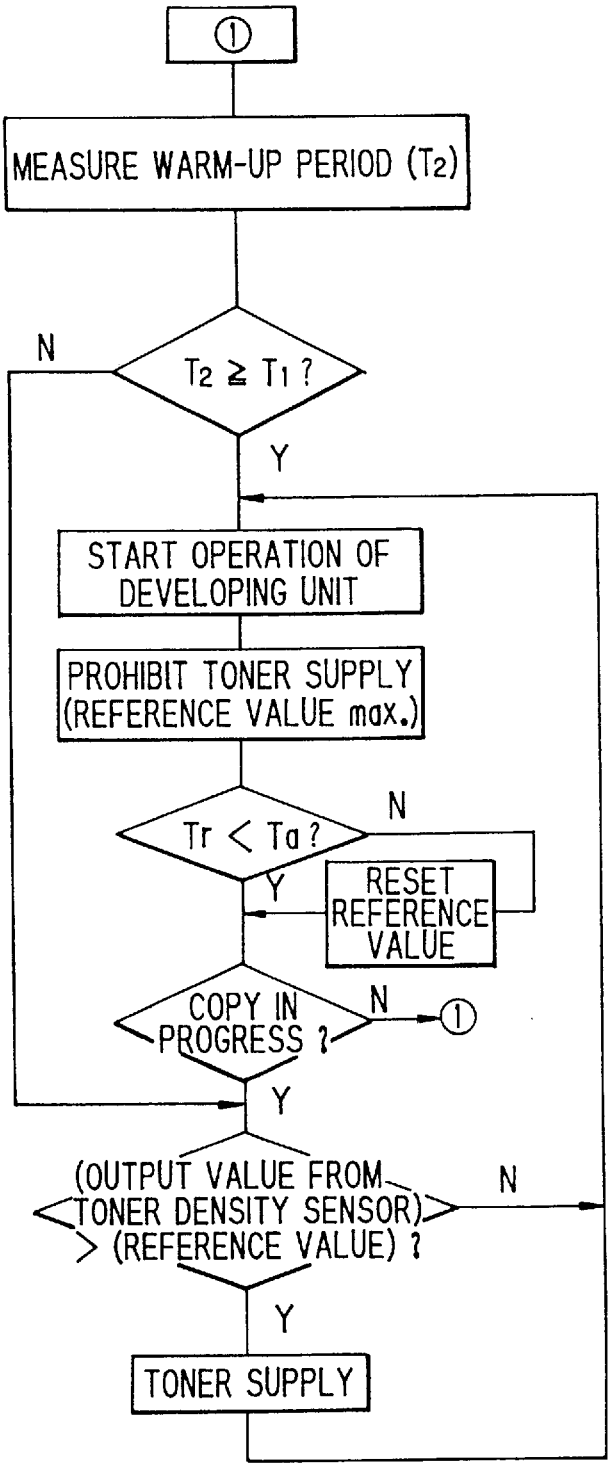
FIG. 27 is a flowchart showing toner supplying control after the inactive time in accordance with a tenth embodiment.

As shown in FIG. 27, if a warm-up period ($T_2$)is equal to or greater than a predetermined period ($T_2$), toner supply to be effected by the toner supplying portion 106 is prohibited until the output value from the toner density sensor 108 recovers itself to a value in conformity with the actual toner density. This prohibition of toner supply is done by setting up the reference value at the maximum for a previously set up constant duration Ta so that the output value from the toner density sensor 108 may not be higher than the reference value. As the operation time Tr of the developing unit G becomes equal to or greater than the constant duration Ta, the agitation of the developer reaches a sufficient level and the quantity of charge on toner is stabilized. At this point, the reference value is reset to a predetermined value so that normal toner supplying control is made.

In contrast, if the warm-up period ($T_2$) is shorter than the predetermined time ($T_1$), the normal toner supplying operation in conformity with the output value from the toner density sensor 108 is effected from when the developing unit G is activated. Here, other components and operations are the same with those in the eighth embodiment, and the same components with those used in the eighth embodiment are allotted with the same reference numerals.

Thus, the use of the warm-up timer 130 for measuring the warm-up period after the activation of the fixing unit in place of the inactive interval timer 126 of the eighth embodiment, makes it possible to attain the same result as in the eighth embodiment. Further, in the case where the warm-up timer 130 is used which measures only the time after the power-activation, the electric circuit can be simplified to thereby reduce the cost.

(Eleventh embodiment)

The controller 122 in an eleventh embodiment has a toner supply controlling function which, in place of prohibiting toner supply to be effected by the toner supplying portion 106 for a predetermined duration when the warm-up period is equal to or longer than a predetermined period of time, regulates toner supply to be effected by the toner supplying portion 106 by setting up the reference value for the toner density sensor 108 in accordance with a predeterminedly set up correction table classified in association with different warm-up periods.

Figure 28:
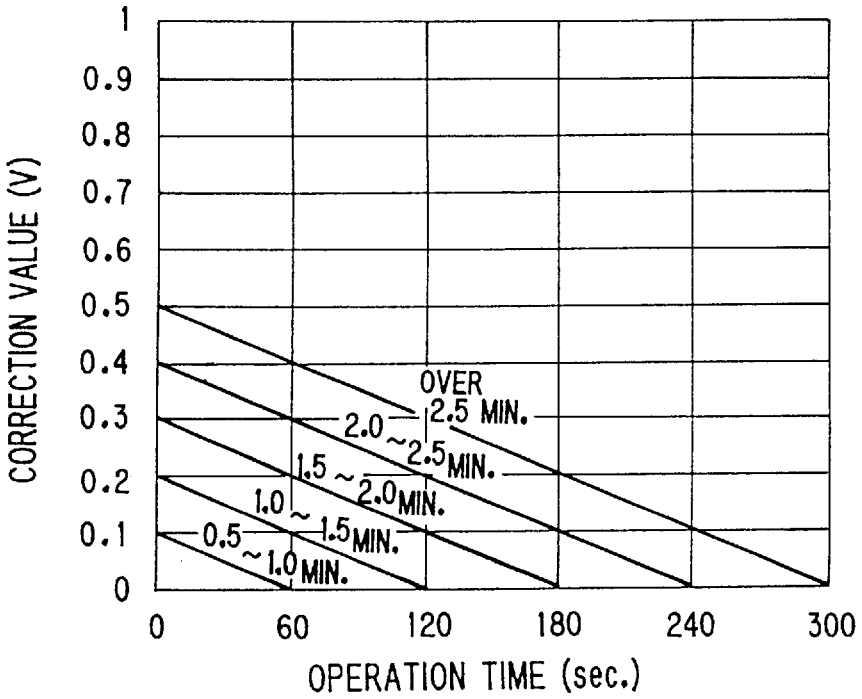
FIG. 28 is a graph showing correction values for correcting a toner density reference value to be set up in association with the operation time of a developing unit for different warm-up periods.

FIG. 28 is a graph showing correction values which are set up in association with the operation time for different warm-up periods. These correction values are to be added to the reference value for the toner density sensor 108. The correction table classified as to different warm-up periods is formed by storing those correction values of the graph into memory. The correction value which is attenuated with the passage of the operation time of the developing unit G can be calculated based on the following formula:

$$\Delta V2 = aTr + cT_2 (\Delta V2 \geqq 0)$$

where ΔV2: a correction value (V); a: a developer characteristics correcting coefficient; Tr: an operation time of the developer G (sec.); c: a warm-up time coefficient; and $T_2$: a warm-up period (min.).

Accordingly, the reference value for the toner density sensor 108 is set up by adding 0.3V to the original reference value if for example, the warm-up time is 1.5 to 2.0 min. As the operation time of the developing unit G increases, the correction value to be added becomes attenuated. For example, the value to be added reduces to 0.2 V after 60 sec., and to 0.1 V after 120 sec., and the reference value is adapted to recover itself to the original reference value after 180 sec. The attenuation of the correction value to be added is set up in view of the fact that the quantity of charge on the developer gradually increases and therefore the output value from the toner density sensor 108 decreases with the augment of the operation time of the developing unit G after the start of agitation of the developer from the activation of the developing unit G.

Figure 29:
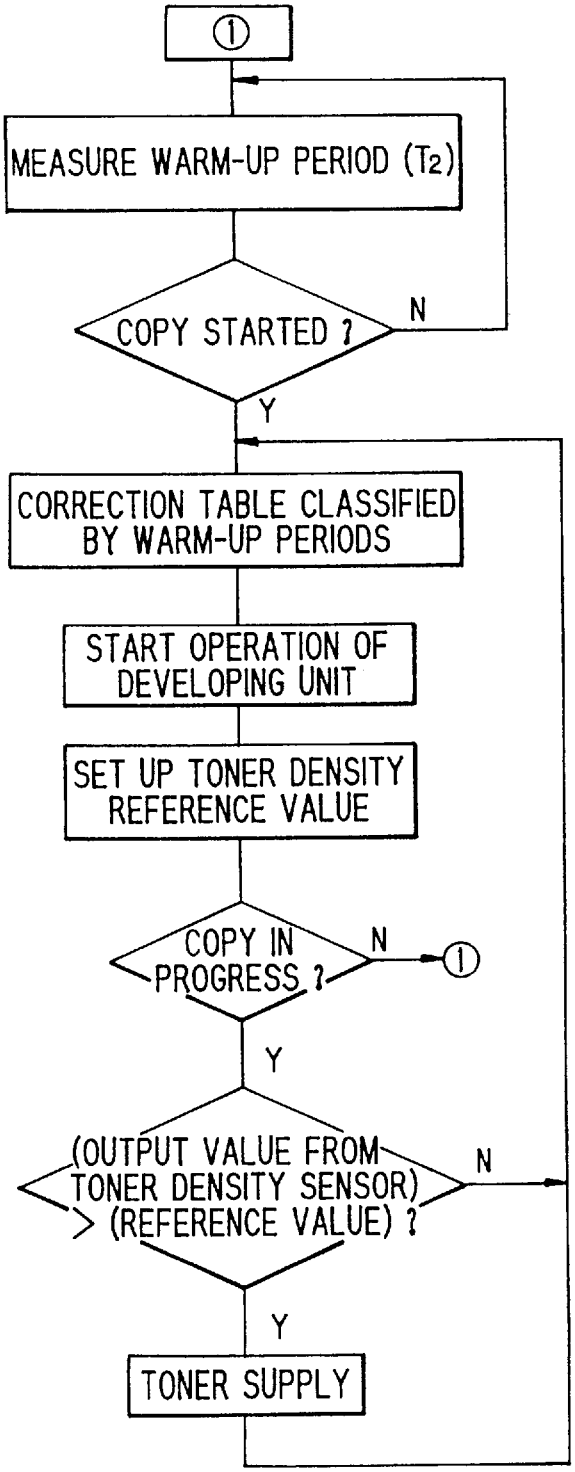
FIG. 29 is a flowchart showing toner supplying control after the inactive time in accordance with an eleventh embodiment.

As shown in FIG. 29, the warm-up timer 130 is made active from the activation of power to measure an warm-up period ($T_2$). When the developing unit G commences to be active, the reference value for the toner density sensor 108 is set up at a specific value in accordance with the correction table classified as to different warm-up periods. Based on the reference value thus set up, the toner supply control is made in accordance with the output value from the toner density sensor 108. Here, other components and operations are the same with those in the tenth embodiment, and the same components with those used in the tenth embodiment are allotted with the same reference numerals.

Thus, the use of the warm-up timer 130 in place of the inactive interval timer 126 of the ninth embodiment, makes it possible to attain the same result as in the ninth embodiment. Further, in the case where the warm-up timer 130 is used which measures only the time after the power-activation, the electric circuit can be simplified to thereby reduce the cost.

(Twelfth embodiment)

The eighth and tenth embodiments, needing separate timer 126 or 130 other than the existing components, tends to have more parts resulting in increased cost.

Figure 30:
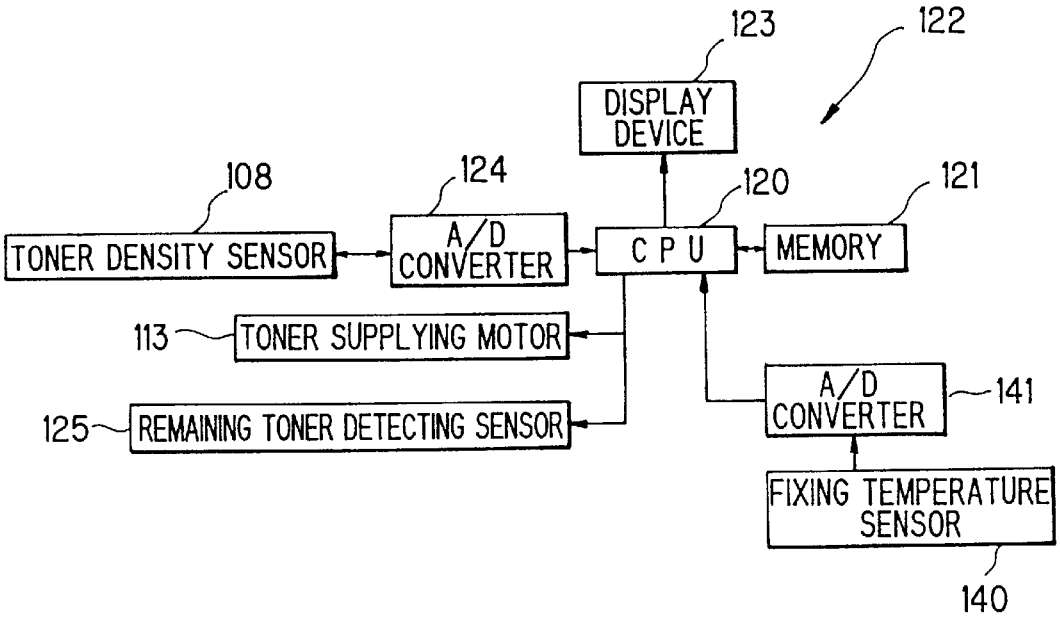
FIG. 30 is a diagram showing a control block for a copier or laser printer in accordance with a twelfth embodiment.

To avoid this, in a twelfth embodiment, as shown in FIG. 30, a fixing temperature sensor 140 is used as an existing temperature detector such as a thermistor etc., for temperature control of the fixing roller in the fixing unit in place of the timer 126 or 130. The controller 122 has a toner supply controlling function of prohibiting toner supply to be effected by the toner supplying portion 106 for a constant duration from the activation of the developing unit G when the temperature of the fixing roller in the fixing unit, detected by the fixing temperature sensor 140 right before the lighting of the heat lamp right after the power-activation of the apparatus is equal to or lower than a predetermined temperature. Here, the fixing temperature sensor 140 is connected to the controller 122 through an A/D converter 141.

Since the temperature of the fixing unit after the power-activation is connected with the duration of the power supply being off, it is possible to determine the inactive time or the duration of being left by measuring the temperature of the fixing unit.

Figure 31:
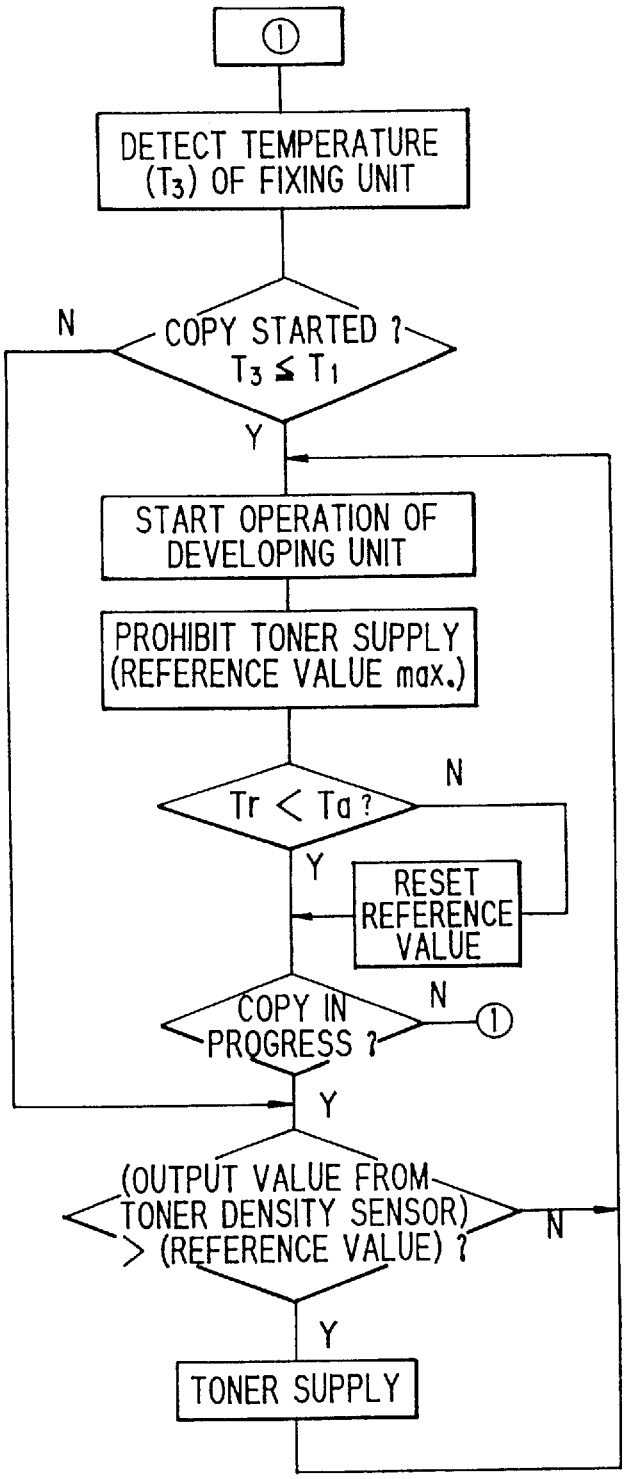
FIG. 31 is a flowchart showing toner supplying control after the inactive time in accordance with a twelfth embodiment.

As shown in FIG. 31, if the temperature ($T_3$) of the fixing unit at the time of the power-activation is equal to or below a predetermined temperature ($T_1$) toner supply to be effected by the toner supplying portion 106 is prohibited until the output value from the toner density sensor 108 recovers itself to a value in conformity with the actual toner density with a sufficient agitation of the developer. This prohibition of toner supply is done by setting up the reference value at the maximum for a previously set up constant duration Ta so that the output value from the toner density sensor 108 may not be higher than the reference value. As the operation time Tr of the developing unit G becomes equal to or greater than the constant duration Ta, the agitation of the developer reaches a sufficient level and the quantity of charge on toner is stabilized. At this point, the reference value is reset to a predetermined value so that normal toner supplying control is made.

In contrast, if the temperature ($T_3$) of the fixing unit is higher than the predetermined temperature ($T_2$), the normal toner supplying operation in conformity with the output value from the toner density sensor 108 is effected from when the developing unit G is activated. Here, other components and operations are the same with those in the eighth embodiment, and the same components with those used in the eighth embodiment are allotted with the same reference numerals.

Thus, the use of the existing fixing temperature sensor 140 for detecting the temperature of the fixing unit in place of the timer 126 or 130 makes it possible to attain the same result as in the eighth embodiment. The use of the existing component result in reduced cost.

(Thirteenth embodiment)

The controller 122 in a thirteenth embodiment has a toner supply controlling function which, in place of prohibiting toner supply to be effected by the toner supplying portion 106 for a predetermined duration when the temperature of the fixing unit is equal to or below a predetermined temperature, or in accordance to output values from the fixing temperature sonsor 140, regulates toner supply to be effected by the toner supplying portion 106 by setting up the reference value for the toner density sensor 108 in accordance with a predeterminedly set up correction table classified in association with different outputs.

Figure 32:
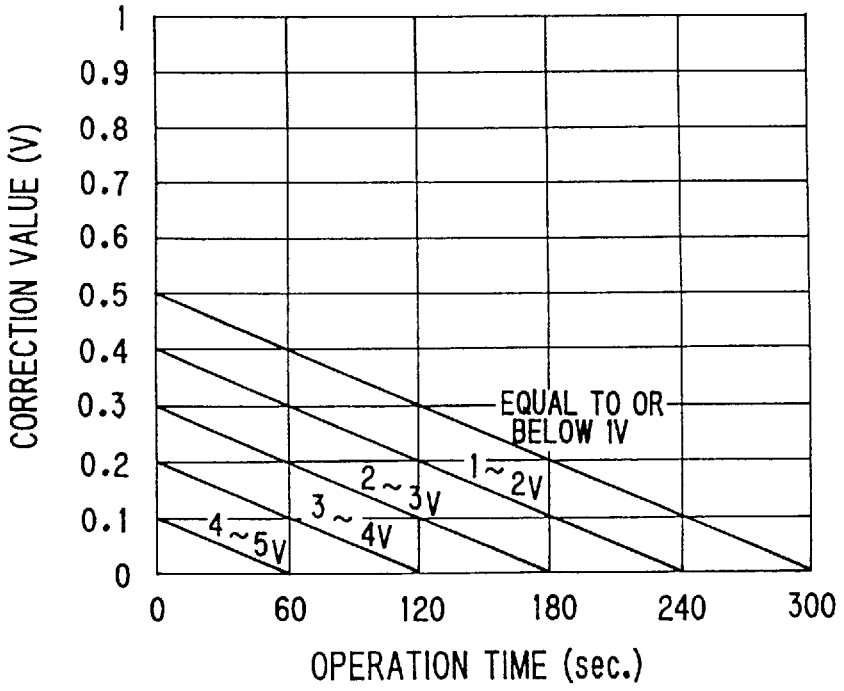
FIG. 32 is a graph showing correction values for correcting a toner density reference value to be set up in association with the operation time of a developing unit for different output values from a fixing temperature sensor.

FIG. 32 is a graph showing correction values which are set up in association with the operation time for different output values from the fixing temperature sensor 140. These correction values are to be added to the reference value for the toner density sensor 108. The correction table classified as to output values from the fixing temperature sensor 140 is formed by storing those correction values of the graph into memory. The correction value which is attenuated with the passage of the operation time of the developing unit G can be calculated based on the following formula:

$$\Delta V3 = aTr + dT_3 (\Delta V3 \geqq 0)$$

where ΔV3: a correction value (V); a: a developer characteristic correcting coefficient; Tr: an operation time of the developer G (sec.); d: a correcting coefficient of the fixing temperature sensor; and $T_3$: an output value from the fixing temperature sensor (V).

Accordingly, the reference value for the toner density sensor 108 is set up by adding 0.3V to the original reference value if for example, the output value from the fixing temperature sensor 140 is 2 to 3 V. As the operation time of the developing unit G increases, the correction value to be added becomes attenuated. For example, the value to be added reduces to 0.2 V after 60 sec., and to 0.1 V after 120 sec., and the reference value is adapted to recover itself to the original reference value after 180 sec. The attenuation of the correction value to be added is set up in view of the fact that the quantity of charge on the developer gradually increases and therefore the output value from the toner density sensor 108 decreases with the augment of the operation time of the developing unit G after the start of agitation of the developer from the activation of the developing unit G.

Figure 33:
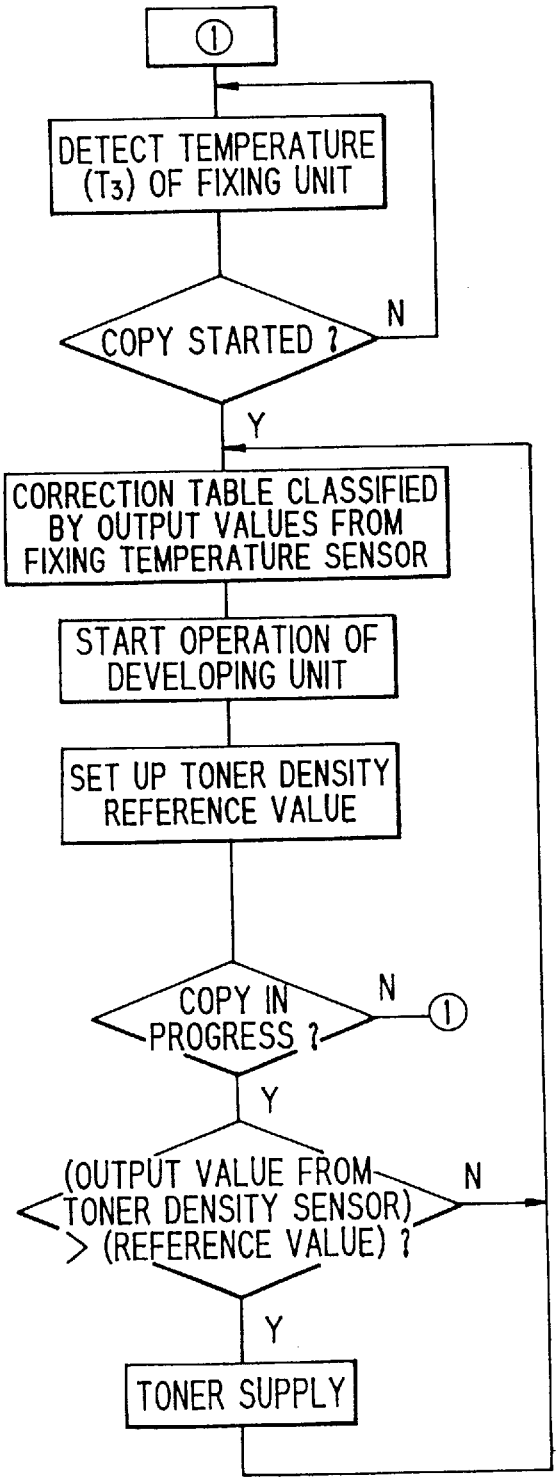
FIG. 33 is a flowchart showing toner supplying control after the inactive time in accordance with a thirteenth embodiment.

As shown in FIG. 33, the fixing temperature sensor 140 detects the temperature of the fixing roller of the fixing unit right before the lightening the heat lamp right after the power-activation to measure the output value ($T_3$). When the developing unit G commences to be active, the reference value for the toner density sensor 108 is set up at a specific value in accordance with the correction table classified as to different output values. Based on the reference value thus set up, the toner supply control is made in accordance with the output value from the toner density sensor 108. Here, other components and operations are the same with those in the twelfth embodiment, and the same components with those used in the twelfth embodiment are allotted with the same reference numerals.

Thus, the use of the existing fixing temperature sensor 140 in place of the timer 126 or 130 makes it possible to attain the same result as in the ninth embodiment. The use of the existing component result in reduced cost.

(Fourteenth embodiment)

Figure 34:
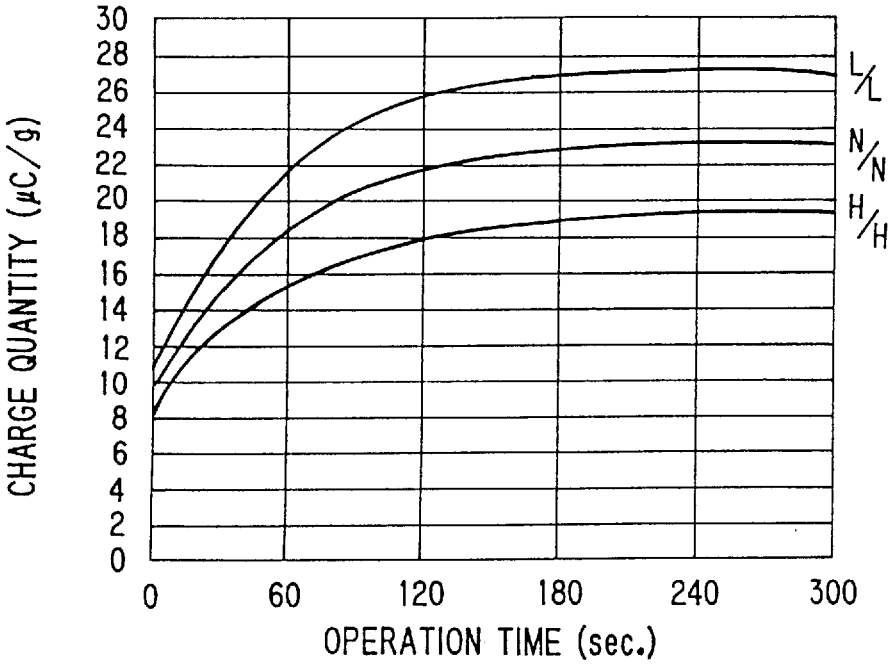
FIG. 34 is a graph showing rising characteristics of the quantity of charge generated in a developing unit in operation for different setup environments.

In general, the electrification of the developer largely depends on the environmental conditions such as temperature and humidity even if their agitating conditions are the same. FIG. 34 shows rising characteristics of the quantity of charge generated in the developing unit G in operation for different setup environments. L/L designates an environment state of 5° C./below 30% R. H.; N/N designates an environment state of 20° C./50% R. H.; and H/H designates an environment state of 35° C./80% R. H and above. As seen from FIG. 34, the quantity of charge rises quickly in the low temperature and low humidity condition whereas the quantity of charge rises slowly in the high temperature and high humidity condition. Therefore, the output value from the toner density sensor 108 varies largely depending on variations of the environmental conditions.

Figure 35:
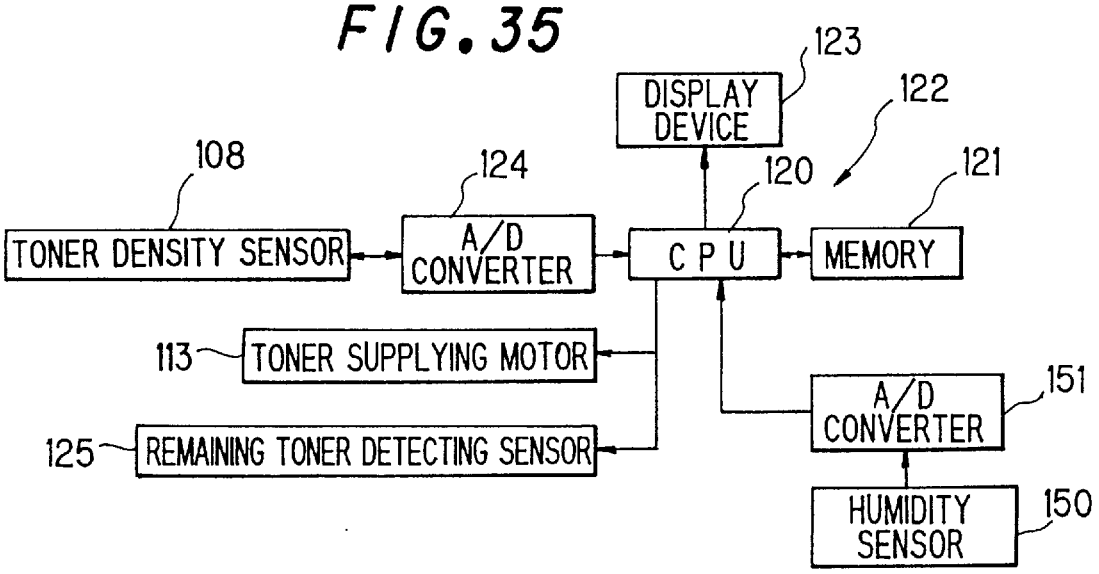
FIG. 35 is a diagram showing a control block for a copier or laser printer in accordance with a fourteenth embodiment.

To deal with this, a fourteenth embodiment, as shown in FIG. 35, uses a ceramic humidity sensor 150 for detecting humidity. The controller 122 has a reference value correcting function of correcting the reference value for the toner density sensor 108 which is set up after the activation of the developing unit in the ninth, eleventh or thirteenth embodiment, based on a previously set up correction table classified by environments or humidity values detected by the ceramic humidity sensor 150. Here, the humidity sensor 150 is connected to the controller 122 via an A/D converter 151.

Figure 36:
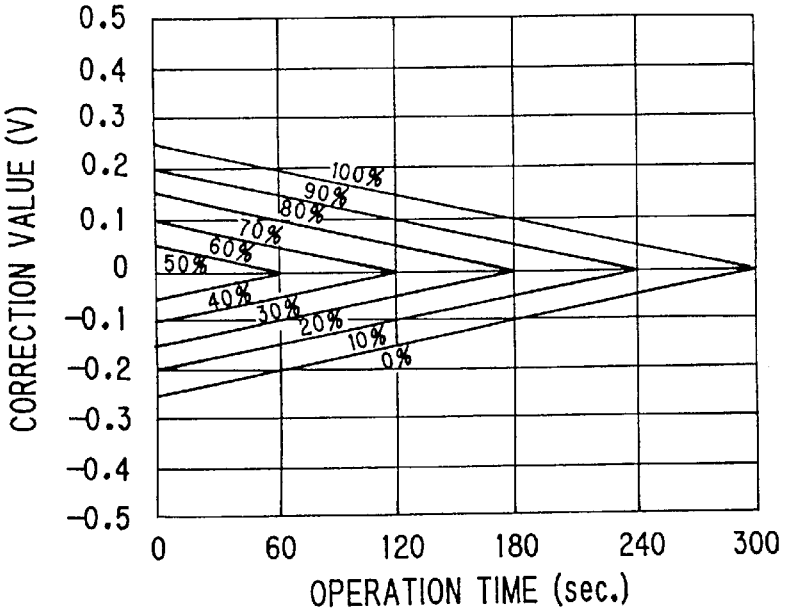
FIG. 36 is a graph showing correction values for correcting a toner density reference value to be set up in association with the operation time of a developing unit for different humidity values.

FIG. 36 is a graph showing correction values which are set up in association with the operation time for different humidity values. These correction values are to be added to the reference value (the reference value set up in association with the inactive interval, warm-up period, temperature of the fixing unit or-the like) for the toner density sensor 108. The correction table classified by humidity is formed by storing those correction values of the graph into memory.

For example, when the humidity is 70%, the set up reference value is added with the correction value, specifically 0.1 V and the correction value to be added becomes attenuated as the operation time of the developing unit G increases. Specifically, the value to be added reduces to 0.05 V after 60 sec., and the reference value is adapted to recover itself to the original reference value after 120 sec., meanwhile, when the humidity is 30%, the set up reference value is added with the correction value, specifically −0.1 V and the correction value to be added becomes attenuated as the operation time of the developing unit G increases. Specifically, the value to be added reduces to −0.05 V after 60 sec., and the reference value is adapted to recover itself to the original reference value after 120 sec. Here, other components and operations are the same with those in the eighth through thirteenth embodiments, and the components having the same functions with those in the eighth through thirteenth embodiments are allotted with the same reference numerals.

In this way, since the reference value for the toner density sensor 108 set up after the activation of the developing unit G in the ninth, eleventh or thirteenth embodiment is corrected in accordance with environmental conditions (especially humidity) affecting the rising characteristics of the charge quantity of the developer or specifically the output value from the toner density sensor 108, the toner density control of the developer can be done by estimating the factors of environmental conditions, and therefore it is possible to keep the toner density more appropriately and to create copy images of high quality.

(Fifteenth embodiment)

Figure 37:
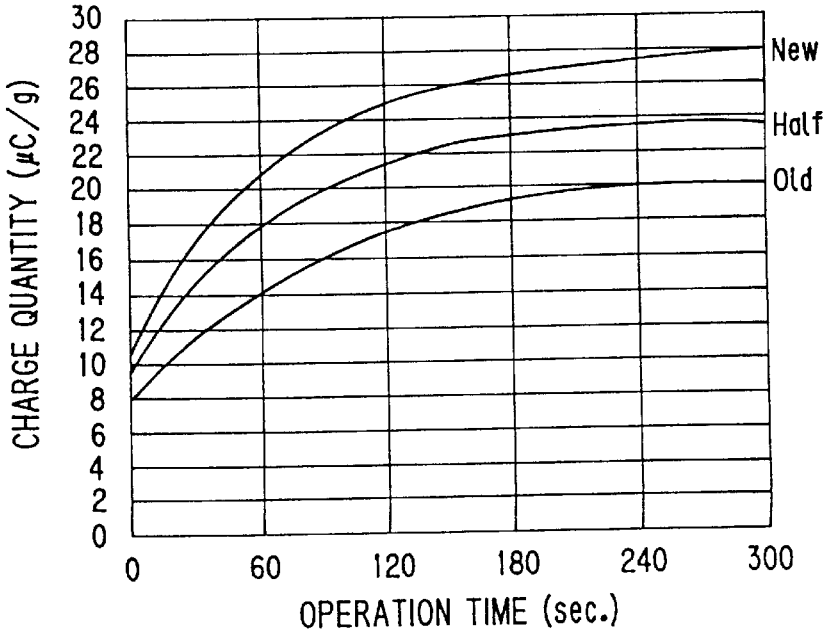
FIG. 37 is a graph showing rising characteristics of the charge quantity in a developing unit in operation in association with the total number of copies.

In general, it is considered that the rising characteristics of the charge quantity on the developer is degraded by toner (spent toner) stuck on carrier surfaces, peeling-off of the coating agent from carrier surfaces, and pulverized toner particles, which are all caused when the developer has been pressed with strong agitating stress inside the developing vessel 102 over a prolonged period of time. FIG. 37 shows rising characteristics of the charge quantity in the developing unit G in operation in relation to the used states of the developer, specifically associated with the total number of copies. In the chart, 'New' indicates the developer with no copy done; 'Half' indicates the developer with 50,000 copies done; and 'Old' indicates the developer with 100,000 copies done. As apparent from FIG. 37, as the developer becomes used and the total number of copies increases, the rising characteristics of the charge quantity with respect to the operation time of the developing unit G becomes low. Therefore the output value from the toner density sensor 108 varies largely depending upon the difference in the total number of copies.

Figure 38:
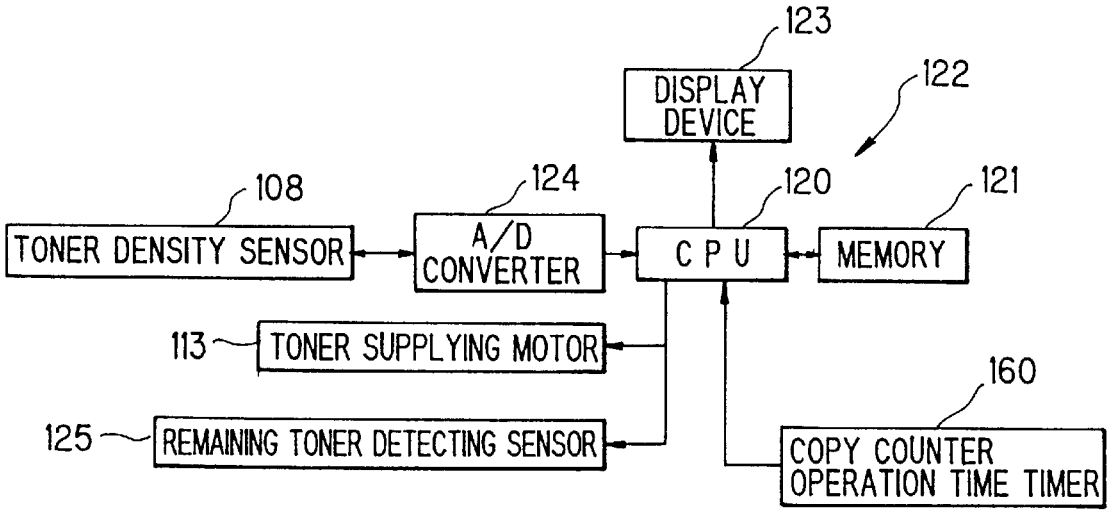
FIG. 38 is a diagram showing a control block for a copier or laser printer in accordance with a fifteenth embodiment.

To deal with the above situation, a fifth embodiment, as shown in FIG. 38, uses a copy counter for counting the total number of copies or a timer 60 for measuring the total operation time of the developing unit G. The controller 122 has a reference value correcting function whereby the developer characteristic correcting coefficient 'a' in each of the correction tables in the ninth, eleventh and thirteenth embodiments is modified in association with the use of the developer, specifically, the total copy number or the total operation time of the developing unit G so as to correct the reference value set up for the toner density sensor 108 after the activation of the developing unit.

Figure 39:
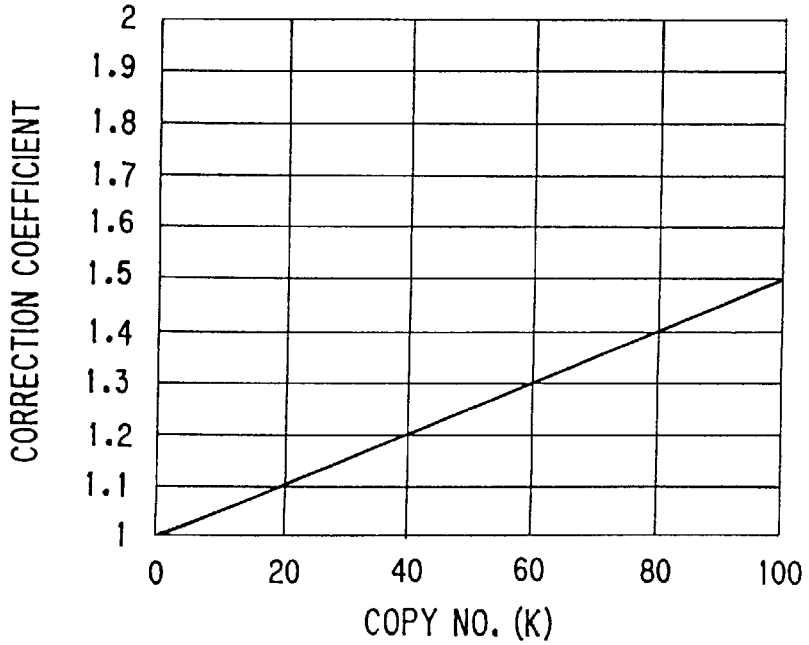
FIG. 39 is a graph showing developer characteristic correcting coefficients for the total number of copies.

The developer characteristic correcting coefficient 'a' is set up for example so as to increase in proportion to the total copy number as shown in FIG. 39. Here, other components and operations are the same with those in the eighth through thirteenth embodiments, and the same components with those used in the eighth through thirteenth embodiments are allotted with the same reference numerals.

In this way, the reference value set up for the toner density sensor 108 after the start of operation of the developing unit G in the ninth, eleventh and thirteenth embodiments is corrected based on the use total (the total copy number or the total operation time of the developing unit G) of the developer which affects the rising characteristics of the charge quantity of the developer or specifically, the output value from the toner density sensor 108. Thus, it possible to control the toner density of the developer with precision by estimating the use total of the developer and therefore it is possible to keep the toner density more appropriately and to create copy images of high quality.

It is to be understood that the invention is not limited to the above embodiments and many modifications and variations can of course be added to the above embodiments within the scope of the invention. In the fourteenth embodiment, although the correction of the reference value for the toner density sensor 108 is made based on only humidity, it is also possible to correct the reference value in accordance with the other environmental conditions such as temperature, atmospheric pressure and the like.

In accordance with the image forming apparatuses of the foregoing embodiments, since toner supply to be effected by the toner supplying portion is prohibited for a predetermined period of time from the activation of the developing unit if the inactive interval from the end of the last operation of the developing unit to the start of a next operation is equal to or more than a predetermined period of time, it is possible to optimally maintain the toner density and stabilize the average quantity of charge on the developer at an appropriate value even when the output value from the toner density detecting portion varies due to the lowering of the quantity of charge on toner during the inactive interval. Accordingly, generation of background foggy, toner scattering and other defects in copy images can be prevented and therefore it is possible to create copy images of high quality.

Further, if for example, the operation of the developing unit is stopped right after toner supply before the developer has been sufficiently agitated, the output value from the toner detecting portion before the inactive interval does not represent its actual toner density. Even in such a case, since toner supply is prohibited for a constant duration from the start of the operation after the inactive interval, the developer can be agitated during the prohibition and therefore the inappropriate output value from the toner density portion before the inactive interval can be modified. As a result it is possible to further stabilize the toner density.

Since toner supply to be effected by the toner supplying portion is not prohibited but regulated by setting up the reference value for the toner density sensor in accordance with the inactive interval from the end of the operation of the developing unit to the start of a next operation, the variation of the output value from the toner density sensor after the state of being left for an inactive interval is estimated so that it is possible to effect precise control of the toner density in the developer, keep the desired toner density and create copy images of high quality, as compared to the configuration in which toner supply is completely prohibited after the inactive interval.

Further, if for example, the developing unit is deactivated right after toner supply and therefore the developer has not been agitated sufficiently, the output value from the toner density sensor 108 will not represent the actual toner density. Even in such a case by setting up the reference value for the toner density sensor at a higher value than in the normal operation, it is possible to sufficiently agitate the developer for a while. Consequently, the inappropriate output value from the toner density sensor before the inactive interval can be modified after the inactive interval, whereby it is possible to attain more stabilized control of the toner density.

By regulating toner supply based on the measurement of the warm-up period after the power-activation of the fixing unit, it is possible to utilize a timer or the like for measuring the time only after the power-activation. As a result, the electric circuit can be simplified and therefore the cost can be reduced, as compared to the configuration where the time from the deactivation of the developing unit to the start of a next operation thereof is to be measured and therefore it is necessary to not only measure the time when the power is on, but also when the power is off.

By regulating toner supply based on the detection of the temperature of the fixing unit right after the power-activation, it is possible to utilize an existing temperature sensor or the like provided for normal temperature control of the fixing unit. Accordingly, it is possible to reduce the cost by using the existing component, as compared to the configuration which needs a timer or the like when the inactive time or the warm-up time is to be measured.

By correcting the reference value set up for the toner density sensor in accordance with environmental conditions affecting the rising characteristics of the charge quantity of the developer or specifically the output value from the toner density sensor, the toner density control of the developer can be executed by estimating the factors of environmental conditions, and therefore it is possible to maintain the toner density.

By correcting the reference value set up for the toner density sensor based on the use total of the developer affecting the rising characteristics of the charge quantity of the developer or specifically, the output value from the toner density sensor, it is possible to control the toner density of the developer with precision by estimating the use total of the developer and therefore it is possible to maintain the toner density.

(Sixteenth embodiment)

Figure 40:
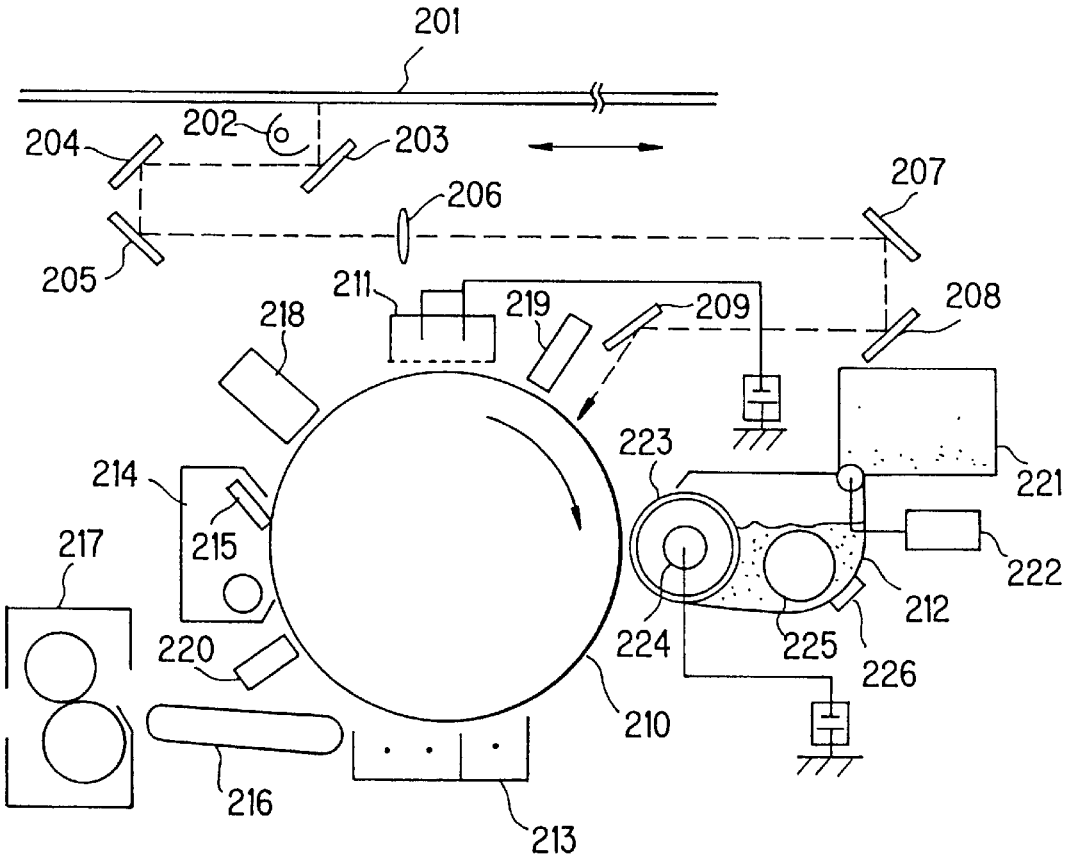
FIG. 40 is a main sectional view showing an image forming apparatus of the invention.

Next, FIG. 40 schematically shows an image forming apparatus to which a toner density correcting method of the invention is applied and the overall configuration and the operation will be described hereinbelow.

As shown in the figure, an image forming apparatus in accordance with a sixteenth embodiment, includes: an original table 201; an exposure lamp 202; a first mirror 203, a second mirror 204, a third mirror 205; a lens 206; a fourth mirror 207; a fifth mirror 208; a sixth mirror 209; a photoreceptor drum 210 of OPC; a charger unit 211; a developing unit 212; a transfer unit 213; a cleaning unit 214; a cleaning blade 215; a paper conveyer unit 216; a fixing unit 217; an erasing lamp 218; a blank lamp 219; a photosensor 220 for detecting the image state on the photoreceptor; a toner hopper 221; a toner supply motor 222; a non-magnetic sleeve 223; a magnet 224; an agitating roller 225; and a toner density sensor 226.

As the copy start button is pressed with a document set on the original table 201, the exposure lamp 202, first mirror 203, second mirror 204, third mirror 205 are adapted to move in parallel to the original table 201 (in the directions of a bidirectional arrow in the figure).

Light emitted from the exposure lamp 202 is reflected on the document placed on the original table 201 and the reflected light is introduced (as indicated by broken lines) through the first mirror 203, second mirror 204, third mirror 205, lens 206, fourth mirror 207, fifth mirror 208, sixth mirror 209 to illuminate the surface of the photoreceptor drum 210 electrified by the charging unit 211. This illumination creates a static latent image on the surface of the photoreceptor drum 210. The blank lamp 219 is selectively turned on so as to illuminate unnecessary part of the static latent image to cancel charges thereon. The thus trimmed latent image is visualized by means of the developing unit 212 into a toner image. The toner image is transferred by means of the transfer unit 213 to the paper supplied from the paper cassette.

The paper with the toner image transferred thereon is conveyed by the paper conveyer unit 216 to the fixing unit 217 where the toner image is fixed on the sheet, and then discharged outside.

A remaining toner image, which is left on the photoreceptor drum 210 after the toner image has been transferred, is scraped to be cleaned by the cleaning blade 215 of the cleaning unit 214, then all the remaining charges on the photoreceptor are canceled by the erasing lamp 218.

The developing unit 212 is composed of the non-magnetic sleeve 223 disposed opposite the photoreceptor 210 and rotationally driven and the agitating roller 225 for agitating the developer. The developer is agitated by the agitating roller 225 and the carriers and toner particles are friction-electrified. The developer is conveyed by the action of the magnet 224 fixed inside the non-magnetic sleeve 223 and toner particles in the developer are transferred to the static latent image formed on the photoreceptor 210 to form a visualized image.

Figure 42:
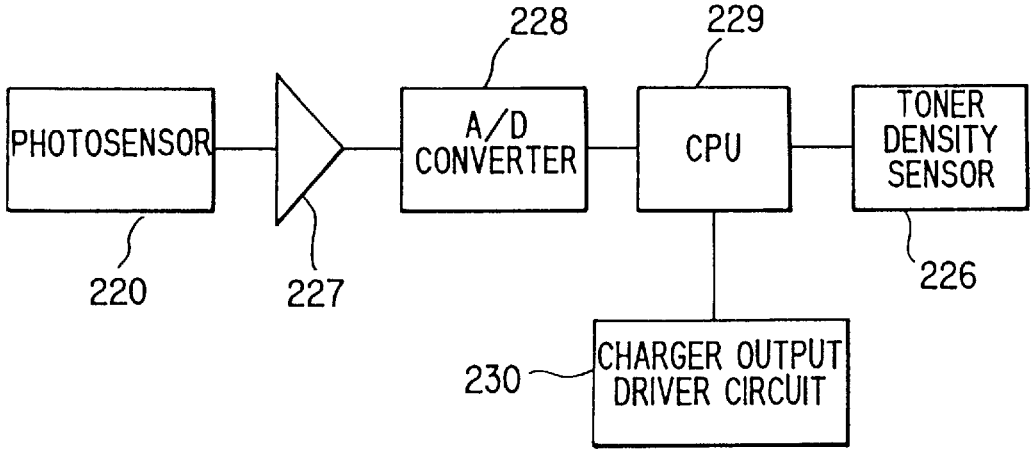
FIG. 42 is a diagram showing a control block of the invention.

Because only the toner of the developer is consumed in the above operation, a toner density sensor 226 attached inside the developing unit detects the change of the toner density inside the developing unit as shown in FIG. 42. The thus detected measurement of the current toner density is compared to a reference value of the initial toner density inside the developing unit which has initially been memorized in a CPU 229. If the output from the toner density sensor 226 is higher than the toner density reference value, the toner density inside the developing unit is determined as to be low and the toner supply motor 222 is activated to rotate to supply the toner stored inside the toner hopper 221 into the developing unit.

Independently of the above toner control scheme, in the image forming apparatus having an image stabilizing device, the above copying process is interrupted as necessary and process control will be effected under specific conditions, periodically (whenever a regular number of copies has been made or a regular period of time has elapsed) and at the time the apparatus is activated. As shown in FIG. 42, the density of toner patches formed on the photoreceptor 210 is detected by the photosensor 220, whose output is amplified to an appropriate level by an amplifier 227 and then converted into digital quantity by an A/D converter 228 so as to be inputted to the CPU 229. Based on the thus inputted value, a charger output driver circuit 230 and the like are operated to correct parameters for the electrophotographic process.

Detailedly, a plurality of static latent images having different surface potentials are created by varying the charger output. These latent images are developed by the developing unit 212 into toner patches having different density levels which are in turned detected by the photosensor 220. If one of these detected values corresponds to a predetermined value P, the charger output which created the static latent image of the toner patch corresponding to the value P is adopted as a charger output for copying operation.

Since the number of patches having a plurality of different density created is limited, a toner patch whose density corresponds to the predetermined value P is not always formed. In such a case or if there is no toner patch corresponding, a charger output Vg may be calculated based on detected values P1, P2 (satisfying the relation P1<P<P2) by the photosensor 220 which are closest to the predetermined value P. Suppose that the detected values P1 and P2 correspond to charger outputs Vg1 and Vg2, respectively, relations Vg1=aP1+b and Vg2=aP2+b will be expectedly held. Accordingly, it is possible to calculate a and b from the two relations. From this result, the target charger output Vg is determined based on the relation Vg=aP+b.

Figure 41:
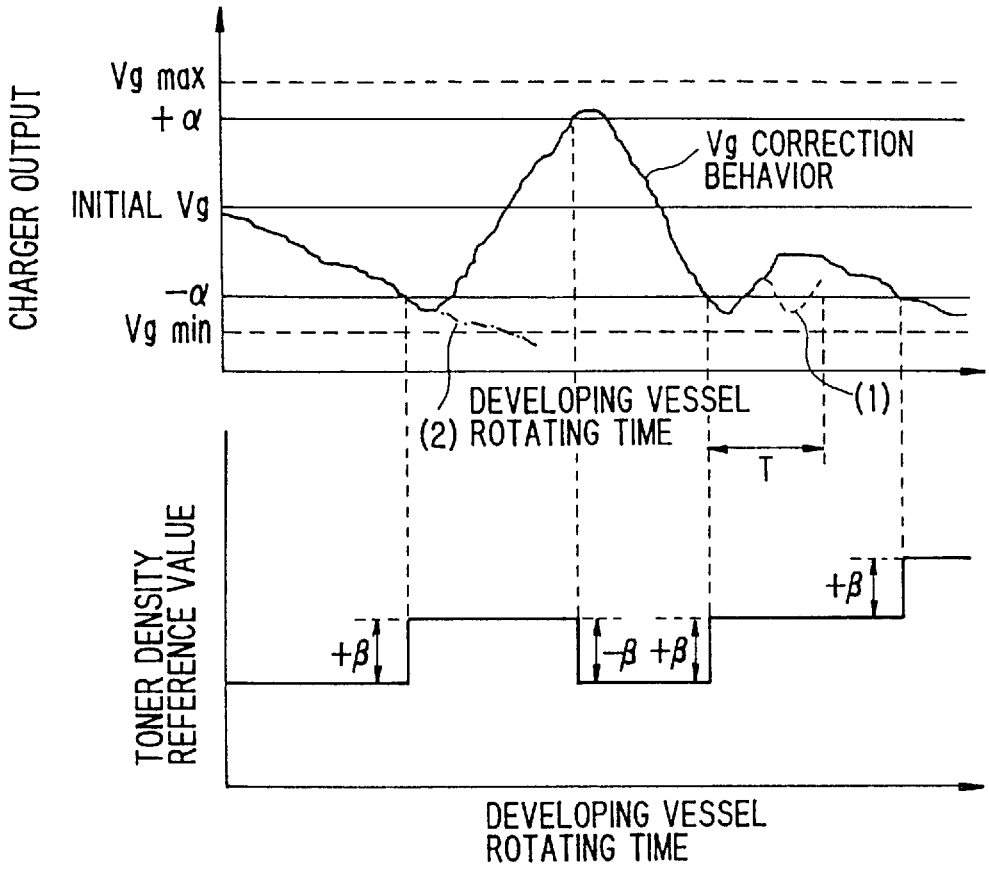
FIG. 41 is a chart showing a relation between the charger output and variations of toner density reference values in an image forming apparatus of the invention.

In this way, the charger output Vg is modified at regular intervals. The change of the charger output Vg is shown in FIG. 41.

Figure 43:
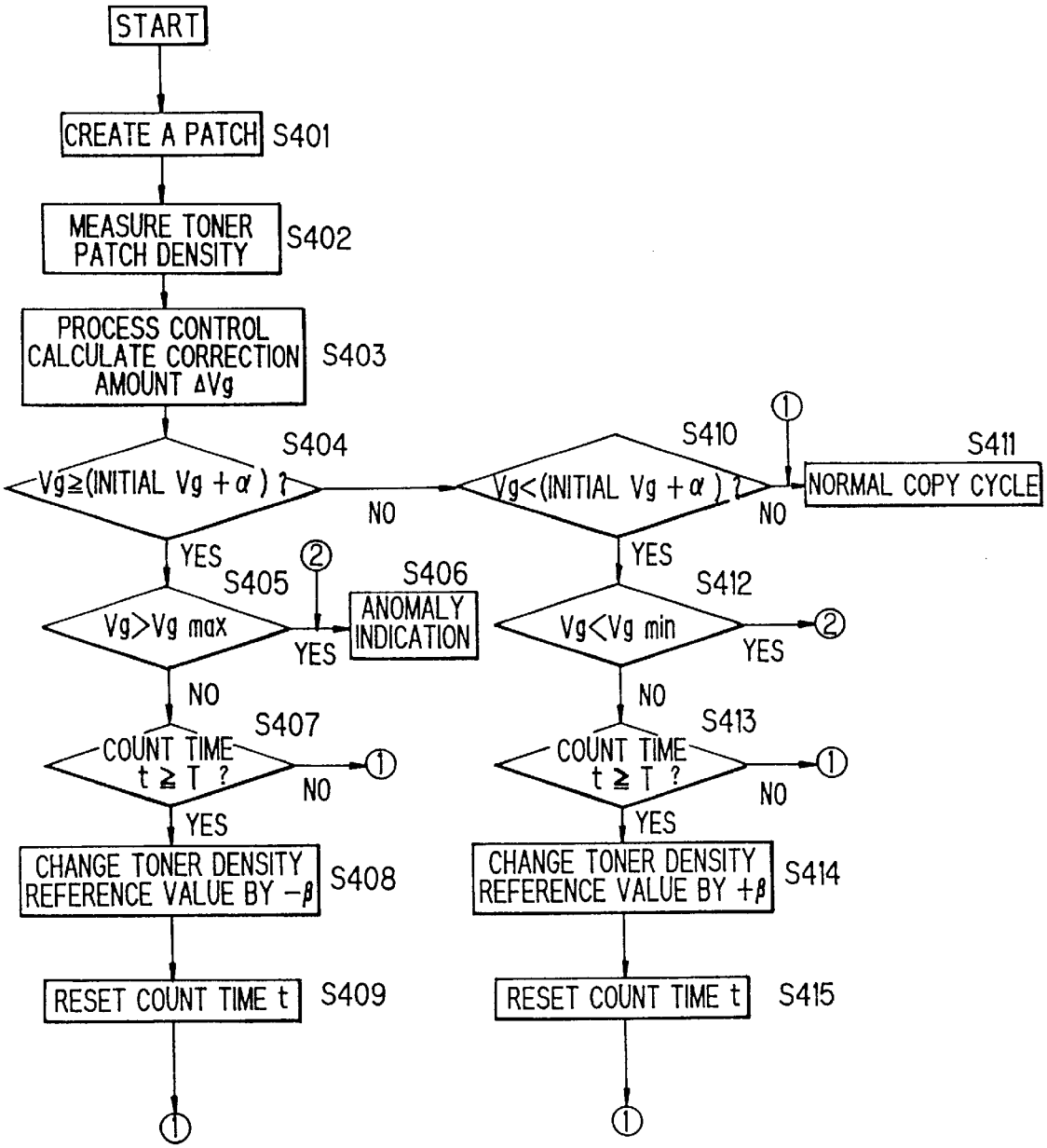
FIG. 43 is a flowchart showing the operation of the invention.

Referring next to a flowchart shown in FIG. 43, the operation of the sixteenth embodiment will be described. First, a toner patch is formed on the photoreceptor and detected on its toner patch density. Based on the data thus obtained, process control is performed to correct parameters related to the electrophotographic process. Upon the control, if the charger output Vg is corrected to a value equal to or greater than (initial Vg+α), it is judged if the value is equal to or lower than a maximum (Vgmax) of the charger output. If the value exceeds the maximum, an anomaly indication will be displayed (S401 through S406).

If the value does not exceed Vgmax, it is judged if t≧T, that is, if a count time t from the previous change of the toner density reference value is equal to or greater than T (T is a period of time required for the toner density in the developing unit to be stabilized after the change of the toner density reference value). If the judgment is affirmative, the toner density correcting reference value is changed by −β (S407 and S408).

Unless t≧T, the operation returns to the normal copy cycle. After the toner density correcting reference value is changed by −β, the count time t is reset and the operation returns to the normal copy cycle (S409).

Next, if the charger output Vg is corrected to a value equal to or smaller than (initial Vg −α), it is judged if the value is equal to or greater than a minimum (Vgmin) of the charger output. If the value is smaller than the minimum, an anomaly indication will be displayed (S410 through S412).

If the value is not inferior to Vgmin, it is judged if t≧T holds, that is, if the count time t from the previous change of the toner density reference value is equal to or greater than T. If the judgment is affirmative, the toner density correcting reference value is changed by +β(S413 and S414).

Unless t≧T, the operation returns to the normal copy cycle. After the toner density correcting reference value is changed by +β, the count time t is reset and the operation returns to the normal copy cycle (S415).

In the invention, when the process control is effected, as shown in FIG. 41, of the corrected parameters, if the charger output Vg is corrected to a value equal to or below (initial Vg −α), it is determined that the developing performance is too high and the toner density reference value is changed by +β. This modification lowers the toner density in the developing unit. Thereafter, the current reference value will be maintained until another correction of the charger output beyond the range of (initial Vg ±α) is to be made.

Conversely, if the charger output Vg is corrected to a value equal to or below (initial Vg +α), it is determined that the developing performance is too low and the toner density reference value is changed by −β. This modification increases the toner density in the developing unit. Thereafter, the current reference value will be maintained until another correction of the charger output beyond the range of (initial Vg ±α) is to be made. Thus, it is possible to obtain stabilized quality of image over a prolonged period of time.

In FIG. 41, the lateral axis is named a rotating time in the developing vessel, which indicates the rotational time of the non-magnetic sleeve 223, that is, total operation time of the developing unit 212 from the power-activation with non-operation time of the developing unit excluded.

If the toner density reference value is changed, it takes time after the correction for the toner density value inside the developing vessel to change to the toner density reference value. When the toner density reference value is changed so as to increase the toner density inside the developing unit, toner supply to the developer will be frequently performed immediately after the change.

(Seventeenth embodiment)

When the toner density reference value is changed so as to decrease the toner density inside the developing unit, the toner density inside the developing unit will not lower unless a certain amount of copies are taken. Accordingly, as indicated at (1) in FIG. 41, even if the charger output Vg is corrected to (initial Vg ±α) within the time T from the change of the toner density reference value until the toner density inside the developing unit is stabilized, the modification of the toner density reference value will be prohibited. This feature enables more stabilized toner density control as compared to the sixteenth embodiment.

Here, the count time t will be reset (t←0) when the apparatus is energized. The count time t is counted up during only the operating time of the developing unit, whereby the aforementioned rotating time in the developing vessel is measured.

(Eighteenth embodiment)

Further, in the normal state, the charger output must be corrected to increase after the change of the toner density reference value by +β. But if the charger output is corrected lower than the minimum (Vgmin) as indicated at (2) in FIG. 41, or conversely, when the charger output is corrected greater than the maximum (Vgmax) as indicated at (2) in FIG. 41 after the toner density reference value is changed by −β, it is judged that some trouble happens in the image forming apparatus and consequently, the apparatus is determined in an anomalous state.

In accordance with the image forming apparatus of the foregoing embodiments, it is possible to prevent lowering of tone reproducing performance, augment of toner consumption, increased background foggy, toner scattering and other defects, all attributed to the elevation of the image density due to the lowering of the quantity of charge on the developer as having been exposed to a high temperature and humidity environment or after a prolonged period of inactive state.

It is also possible to prevent occurrences of problems such as lowering of the image density, degradation of transfer performances and the like due to the elevation of the quantity of charge on the developer as having been exposed to a low temperature humidity environment, after a continuous copying operation or the like.

It is possible to effect appropriate toner density corrections and thus it is possible to produce markedly stabilized images.

In the above embodiment, upon the change of the toner density reference value, copying must be continued to a certain degree right after the toner density reference value is changed, in order for the toner density of the developer to reach the modified reference value. Accordingly, it is possible to prevent redundant modification of the toner density reference value by correcting the charger output in the round of the process control which would be activated by erroneous determination that the modification of the toner density has not been performed yet despite that actual change of the toner density reference value has been done. As a result, it is possible to effect more stabilized control of the toner density inside the developing unit.

Further, in the embodiment, if the toner density reference value has been modified so as to increase the toner density inside the developing unit, the charger output is adapted to be decreased. In contrast, if the toner density reference value has been modified so as to decrease the toner density inside the developing unit, the charger output is adapted to be increased. Nevertheless, after the modification of the toner density reference value, the charger output deviates beyond the predetermined maximum or minimum, it is judged that some trouble happens in the image forming apparatus and consequently the apparatus can be determined in an anomalous state.

It should be apparent from the aforementioned description and attached drawings that the concept of the present application may be readily applied to a variety of preferred embodiments including those disclosed herein. Accordingly, the scope of the invention described in the instant application should be limited solely by the appended claims.

What is claimed is:

1. An image forming apparatus comprising:

a toner density sensor for detecting a toner density of a two-component developer stored in a developing vessel;

toner density control means for comparing an output from said toner density sensor with a reference toner density and maintaining the toner density of the developer at the reference toner density by controlling the amount of supplying toner to the developing vessel;

agitation total detecting means for detecting as an agitation total one of a number of agitations of the developer inside the developing vessel, an approximate operation time of the image forming apparatus and a number of images formed, any of which is proportional to the number of agitations;

toner density correcting means for correcting the output from one of said toner density sensor and the reference toner density in association with an augment of the agitation total;

toner patch density detecting means for creating a toner patch on a photoreceptor and detecting a density of the toner patch;

process parameter controlling means for controlling process parameters including an applied voltage to a main charger in order to adjust the toner patch density detected by said toner patch density detecting means to a predetermined density value; and toner density correction canceling means for canceling a correction by said toner density correcting means when the process parameter has reached a predetermined value with improvement of developing performances of the developer.

2. An image forming apparatus according to claim 1 wherein said toner density correction canceling means is adapted to gradually reduce the correction by said toner density correcting means with the augment of said agitation total.

3. An image forming apparatus according to claim 1 further comprising means for activating said process parameter controlling means after said toner density correction is canceling means has canceled the correction set up by said toner density correcting means.

4. An image forming apparatus comprising:

a toner density detecting portion for detecting a toner density of a two-component developer having toner and carriers and stored in a developing vessel in a developing unit;

a toner supplying portion for supplying toner into the developing vessel until an output value from said toner density detecting portion reaches a reference value;

inactive-interval measuring means for measuring an interval from the end of operation of the developing unit to the start of a next operation thereof; and toner supply controlling means for prohibiting the toner supply to be effected by said toner supplying portion for a constant duration from an activation of said developing unit when the inactive interval is equal to or longer than a predetermined period of time.

5. An image forming apparatus according to claim 4 wherein a warm-up period of a fixing unit for fusing and fixing toner transferred to a recording sheet from the activation of power supply to when the fixing unit reaches a prescribed temperature is measured in place of measuring the interval from the end of operation of the developing unit to the start of a next operation thereof, and toner supply is effected based on the warm-up period.

6. An image forming apparatus according to claim 5 further comprising reference value correcting means for correcting the reference value set up for said toner density detecting portion.

7. An image forming apparatus according to claim 5 further comprising reference value correcting means for correcting the reference value set up for said toner density detecting portion, in accordance with the use total of the developer.

8. An image forming apparatus according to claim 4 wherein the temperature of a fixing unit for fusing and fixing toner transferred to a recording sheet is measured immediately after the activation of power supply in place of measuring the interval from the end of operation of the developing unit to the start of a next operation thereof, and toner supply is effected based on the temperature.

9. An image forming apparatus according to claim 8 further comprising reference value correcting means for correcting the reference value set up for said toner density detecting portion.

10. An image forming apparatus according to claim 8 further comprising reference value correcting means for correcting the reference value set up for said toner density detecting portion, in accordance with the use total of the developer.

11. The image forming apparatus according to claim 4, wherein the toner supply controlling means permits the toner supply to be effected when the inactive interval is less than the predetermined period of time and a number of copies to be made in a current copying operation exceeds a second predetermined number.

12. An image forming apparatus comprising:

a toner density detecting portion for detecting a toner density of a two-component developer having toner and carriers and stored in a developing vessel in a developing unit;

a toner supplying portion for supplying toner into the developing vessel until an output value from said toner density detecting portion reaches a reference value;

inactive-interval measuring means for measuring an interval from the end of operation of the developing unit to the start of a next operation thereof; and toner supplying controlling means for setting up a reference value for said toner density detecting portion in conformity with the inactive interval and regulating the toner supply to be effected by said toner supplying portion based on the setup reference value.

13. An image forming apparatus according to claim 12 wherein a warm-up period of a fixing unit for fusing and fixing toner transferred to a recording sheet from the activation of power supply to when the fixing unit reaches a prescribed temperature is measured in place of measuring the interval from the end of operation of the developing unit to the start of a next operation thereof, and toner supply is effected based on the warm-up period.

14. An image forming apparatus according to claim 13 further comprising reference value correcting means for correcting the reference value set up for said toner density detecting portion.

15. An image forming apparatus according to claim 13 further comprising reference value correcting means for correcting the reference value set up for said toner density detecting portion, in accordance with the use total of the developer.

16. An image forming apparatus according to claim 12 wherein the temperature of a fixing unit for fusing and fixing toner transferred to a recording sheet is measured immediately after the activation of power supply in place of measuring the interval from the end of operation of the developing unit to the start of a next operation thereof, and toner supply is effected based on the temperature.

17. An image forming apparatus according to claim 16 further comprising reference value correcting means for correcting the reference value set up for said toner density detecting portion.

18. An image forming apparatus according to claim 16 further comprising reference value correcting means for correcting the reference value set up for said toner density detecting portion, in accordance with the use total of the developer.

19. An image forming apparatus according to claim 12 further comprising reference value correcting means for correcting the reference value set up for said toner density detecting portion.

20. An image forming apparatus according to claim 12 further comprising reference value correcting means for correcting the reference value set up for said toner density detecting portion, in accordance with the use total of the developer.

21. An image forming apparatus comprising:

an image density controlled regularly by forming a patch of toner on a photoreceptor and varying a charger output as one of image forming conditions based on the density of a patch and control of toner supply to a developing unit is effected so that a toner density in the developing unit corresponds to a toner density reference value, wherein when the variation as to the charger output is equal to or greater than a first predetermined value, the toner density reference value is changed and then maintained until the variation of the charger output becomes equal to or greater than the first predetermined value.

22. An image forming apparatus according to claim 21 wherein after a change of the toner density reference value, another change of the toner density reference value is prohibited for a predetermined period of time.

23. An image forming apparatus according to claim 21 wherein after the modification of the toner density reference value, if the variation of the charger output is equal to or greater than a second predetermined value, the image forming apparatus is detected to be in an anomalous state.

24. An image forming apparatus comprising:

a toner density sensor that detects a toner density of a two-component developer stored in a developing vessel;

a toner density control unit that compares an output from said toner density sensor with a reference toner density and maintaining the toner density of the developer at the reference toner density by controlling the amount of supplying toner to the developing vessel;

an agitation total detecting unit that detects as an agitation total one of a number of agitations of the developer inside the developing vessel, an approximate operation time of the image forming apparatus and a number of images formed, any of which is proportional to the number of agitations;

a toner density correcting unit that corrects the output from one of said toner density sensor and the reference toner density in association with an augment of the agitation total;

a toner patch density detecting unit that creates a toner patch on a photoreceptor and detecting a density of the toner patch;

a process parameter controlling unit that controls process parameters including an applied voltage to a main charger in order to adjust the toner patch density detected by said toner patch density detecting unit to a predetermined density value; and a toner density correction canceling unit that cancels a correction by said toner density correcting unit when the process parameter has reached a predetermined value with improvement of developing performances of the developer.

25. An image forming apparatus comprising:

a toner density detecting portion that detects a toner density of a two-component developer having toner and carriers and stored in a developing vessel in a developing unit;

a toner supplying portion that supplies toner into the developing vessel until an output value from said toner density detecting portion reaches a reference value;

an inactive-interval measuring unit that measures an interval from the end of operation of the developing unit to the start of a next operation thereof; and a toner supply controlling unit that prohibits the toner supply to be effected by said toner supplying portion for a constant duration from an activation of said developing unit when the inactive interval is equal to or longer than a predetermined period of time.

26. A method for forming an image in an image forming apparatus, comprising the steps of:

(a) detecting a toner density of a two-component developer stored in a developing vessel;

(b) comparing an output from step (a) with a reference toner density and maintaining the toner density of the developer at the reference toner density by controlling the amount of supplying toner to the developing vessel;

(c) detecting as an agitation total one of a number of agitations of the developer inside the developing vessel, an approximate operation time of the image forming apparatus and a number of images formed, any of which is proportional to the number of agitations;

(d) correcting the output from the developer toner density and the reference toner density in association with an augment of the agitation total;

(e) creating a toner patch on a photoreceptor and detecting a density of the toner patch;

(f) controlling process parameters including an applied voltage to a main charger in order to adjust the detected toner patch density to a predetermined density value; and (g) canceling the developer toner density output correction when the process parameter has reached a predetermined value with improvement of developing performances of the developer.

27. A method for forming an image, comprising the steps of:

(a) detecting a toner density of a two-component developer having toner and carriers and stored in a developing vessel in a developing unit;

(b) supplying toner into the developing vessel until an output value from the detecting step (a) reaches a reference value;

(c) measuring an interval from the end of operation of the developing unit to the start of a next operation thereof; and (d) prohibiting the toner supply to be effected for a constant duration from an activation of said developing unit when the inactive interval is equal to or longer than a predetermined period of time.

* * * * *